US007461611B2

(12) United States Patent
Hebden et al.

(10) Patent No.: US 7,461,611 B2
(45) Date of Patent: Dec. 9, 2008

(54) FLOATING PONTOON BERTHING FACILITY FOR FERRIES AND SHIPS

(76) Inventors: Raymond Howard Hebden, 989 Barkway Terrace, Brentwood Bay, BC (CA) V8M 1A4; Richard Haigh Cambie Crauford, 10811 Forrilon Place, Richmond, BC (CA) V7A 4G7; Gregory Hugh Paul Ramsay, 824 Delamere Road, Brentwood Bay, BC (CA) V8M 1B1; David John Basnett, 2003-3980 Carrigan Court, Burnaby, BC (CA) V3N 4S6

( * ) Notice: Subject to any disclaimer, the term of this patent is extended or adjusted under 35 U.S.C. 154(b) by 0 days.

(21) Appl. No.: 11/536,552

(22) Filed: Sep. 28, 2006

(65) Prior Publication Data

US 2008/0078319 A1 Apr. 3, 2008

(51) Int. Cl.
*B63B 35/44* (2006.01)

(52) U.S. Cl. ..... 114/263

(58) Field of Classification Search ..... 114/263
See application file for complete search history.

(56) References Cited

U.S. PATENT DOCUMENTS

| | | | | |
|---|---|---|---|---|
| 18,683 | A | 11/1857 | Day | |
| 204,407 | A | 5/1878 | Williams | |
| 2,389,353 | A | 11/1945 | Foss | |
| 2,524,454 | A | 10/1950 | Luther, Jr. | |
| 3,036,539 | A | 5/1962 | Storey | |
| 3,069,862 | A | 12/1962 | Ward | |
| 3,695,046 | A | 10/1972 | Torr | |
| 3,707,934 | A | 1/1973 | Frankel | |
| 3,774,253 | A | 11/1973 | Lecomte | |
| 3,922,992 | A | 12/1975 | Wilbourn | |
| 4,137,861 | A | 2/1979 | Brummenaes | |
| 4,331,097 | A | 5/1982 | Belinsky | |
| 4,345,537 | A | 8/1982 | Ueda et al. | |
| 4,414,911 | A | 11/1983 | Belinsky | |
| 4,426,949 | A | 1/1984 | Knutsen | |
| 4,441,449 | A | 4/1984 | Biaggi | |
| 4,453,488 | A * | 6/1984 | Watchorn | 114/266 |
| 4,697,538 | A | 10/1987 | Day | |
| 5,107,784 | A | 4/1992 | Lacy | |
| 5,170,737 | A | 12/1992 | Poldervaart | |
| 5,215,027 | A | 6/1993 | Baxter | |
| 5,421,282 | A | 6/1995 | Morris | |
| 5,501,625 | A | 3/1996 | Belinsky | |

(Continued)

FOREIGN PATENT DOCUMENTS

EP 0 245 227 A2 11/1987

(Continued)

*Primary Examiner*—Stephen Avila
(74) *Attorney, Agent, or Firm*—Robert H. Barrigar

(57) ABSTRACT

A berthing facility for use in moving vehicles between a shore facility and a bow/stern-loading RORO ferry, having a substantially rigid floating pontoon comprising several modules joined one to another, a two-tier vehicle ramp running from the shore to the pontoon, an element for pivotally securing the pontoon in the vicinity of the ramp and an element for resiliently restraining the pontoon to permit limited controlled pivotal movement about a preferred orientation. The berthing facility also including, hydraulically dampened fenders and wingwalls for dissipating vessel impact force, an integral turning dolphin, apron assemblies for providing continuity of vehicle pathways between the ramp and a ferry, and an element for raising and lowering the ramp.

20 Claims, 10 Drawing Sheets

U.S. PATENT DOCUMENTS

| | | | |
|---|---|---|---|
| 5,823,715 | A | 10/1998 | Murdoch et al. |
| 6,073,571 | A | 6/2000 | Whitener |
| 6,176,192 | B1 | 1/2001 | Torkler |
| 6,470,820 | B1 | 10/2002 | Wilkins |
| 6,786,165 | B2 | 7/2004 | Trepanier |
| 2004/0216485 | A1 | 11/2004 | Landry |
| 2005/0103250 | A1 | 5/2005 | Thomson |
| 2005/0277344 | A1 | 12/2005 | Haun |

FOREIGN PATENT DOCUMENTS

| | | | |
|---|---|---|---|
| FR | 2 586 003 | | 2/1987 |
| GB | 418 424 | | 5/1934 |
| GB | 695 699 | | 5/1952 |
| GB | 804 207 | | 3/1956 |
| GB | 2 043 754 | A | 10/1980 |
| GB | 2 064 437 | A | 6/1981 |
| GB | 2 097 737 | A | 11/1982 |
| WO | WO 88/07605 | | 10/1988 |
| WO | WO 89/11564 | | 11/1989 |

* cited by examiner

FLOATING PONTOON BERTHING FACILITY FOR FERRIES AND SHIPS

FIELD OF THE INVENTION

The invention relates generally to a berthing facility for ships and ferries, and particularly to a berthing facility for use in loading and unloading of vehicles with bow/stern-loading RORO ferries.

BACKGROUND OF THE INVENTION

Ferries are used to transport vehicles and passengers across bodies of water throughout the world. A common general configuration for a passenger/vehicle ferry is the so called "Roll On/Roll Off" design (also identified by the acronyms "RORO" and "ro-ro"). RORO vessels have built-in side, bow and/or stern ports which allow the vehicles to be efficiently "rolled on" and "rolled off" the vessel when in port. (This is in contrast to the more traditional lo-lo (lift on-lift off) vessels which use a crane to load and unload cargo.)

Some RORO type vehicle/passenger ferries have one or more vehicle decks running the length of the vessel, each deck comprising a plurality of vehicle parking lanes, and vehicle access means at the bow and stern (or at either "end" of the vessel in the case of vessels configured to proceed and maneuver equally well in either direction, and thus lacking dedicated bows and sterns). Typically, with such bow/stern-loading ferry, vehicles are loaded by having each vehicle operator drive his or her vehicle on to the ferry and park it in location as designated by ferry staff. Similarly, each vehicle is unloaded by having each vehicle operator drive it off the ferry. This vehicle-operator loading and unloading permits the ferries to be rapidly loaded and unloaded. One slight wrinkle with bow/stern-loading ferries is that as the berthing facilities for such ferries typically only provide vehicle access to one end of the ferry, unless such a ferry is turned after a first set of vehicles is unloaded, the set of vehicles next loaded will be facing in the opposite direction within the ferry as compared to the first set. This means that ferries having dedicated bows and sterns, that is, a preferred direction of travel through the water, must frequently be turned at the end of a passage and brought into the loading/unloading facility stern-first to enable vehicle operators to drive their vehicles forward when exiting the ferry. With a conventional vessel configuration in which the bridge, and thus the helm and other vessel controls, is located closer to the bow than to the stern, stern-first maneuvering is typically more difficult than bow-first maneuvering, in part because of reduced visibility aft compared to visibility forward.

In some cases, such bow/stern-loading ferries are essentially barge-like, having a single uncovered vehicle deck. In other cases, particularly with larger ferries having more than one vehicle deck (i.e. having a vehicle deck above another vehicle deck), the vehicle decks are enclosed within the vessel. These large ferries typically have large ports at the bow and stern, with associated doors that are opened to permit vehicles to enter and exit the vehicle decks, and are closed when the vessel is underway to prevent spray or, in the case of stormy conditions, larger volumes of water from entering the vehicle decks. Some ferries having more than one vehicle deck have only a single pair of vehicle ports; i.e. they provide direct external access to only one vehicle deck and have internal ramps or lifts to permit vehicles to be moved between vehicle decks. However, it is more common for ferries having more than one vehicle deck to also have a second pair of vehicle access ports, with a lower pair of access ports permitting vehicles to directly enter and exit a lower vehicle deck, and an upper pair of access ports permitting vehicles to directly enter and exit an upper vehicle deck.

Ferries making regular runs typically have associated dedicated berthing facilities. Such dedicated berthing facilities for use with bow/stern loading ferries having two pairs of access ports,(i.e. a pair of upper access ports and a pair of lower access ports), typically include two independently operable loading/unloading bridges, one for each pair of access ports. Typically, each such loading/unloading bridge is pivotally attached to a shore facility at its proximal end and is raised and lowered by conventional means for raising and lowering such pivoting bridges (typically, a pair of hydraulic rams, one on each side of the bridge). Typically, the distal portion of each bridge is not directly supported and is essentially a cantilever. In use, once a ferry is secure in the desired loading/unloading position, the distal end of each bridge is lowered to the deck of the relevant access port to provide a vehicle path for loading and unloading. Typically each such bridge has a transition apron pivotally attached to the distal end of the bridge, such that when the distal end of the bridge is brought into proximity with the deck of the access port, the distal end of the transition apron settles onto the deck to provide a transitional vehicle pathway between the vehicle deck and the bridge deck. Typically, due primarily to visibility limitations, it is necessary to have two operators for such double bridge arrangements, one operator for each bridge.

Dolphins are often important components of dedicated berthing facilities for ferries. The term "dolphin" is conventionally used to mean a structure against which a vessel may lay while moored or during a mooring operation. Typically, a dolphin for use with large vessels comprises several piles driven into the seabed in relatively close proximity and attached one to the other so as to provide mutual support to withstand vessel impact forces. A "turning dolphin" is a dolphin used to assist in turning a vessel by laying the vessel against the turning dolphin and causing the vessel to pivot about the turning dolphin. Dolphins used in dedicated ferry berthing facilities often have large rubber bumpers intended to assist in absorbing vessel impact forces. However, such rubber bumpers tend to cause vessels striking them to rebound in an undesirable manner.

To keep costs down and reduce delays, it is preferable for ferry dockings to be accomplished without the assistance of a support vessel such as a tug-boat. Conventionally, dedicated berthing facilities for bow/stern-loading ferries include two rows of dolphins, one on each side of the preferred path to the docking position, the two rows of dolphins being closer together at their near-shore ends than at their outer ends. In this way, if a ferry approaching the docking position diverges from the preferred path it will contact a dolphin so as to be prevented from further divergence from the preferred path. If a ferry hits a conventional dolphin with sufficient force, the ferry will rebound away from the dolphin. This is why there are typically two rows of dolphins; in cases of a significant rebound, the ferry will impact the other row of dolphins, which will limit the ferries divergence from the preferred path. However, if a ferry rebounds with sufficient speed, it could be dangerous for passengers, particularly if they are on foot within the ferry. As the two rows of dolphins typically converge towards their near-shore ends, the amount of divergence from the preferred path permitted by the dolphins diminishes as the ferry approaches the docking position.

Typically, a ferry berthing facility is preferably located so as to make the ferry passage as short as possible while still providing reasonable road access to the facility, and thus ferry berthing facilities may be relatively unprotected with respect to the wind and wave effects of storm conditions, and may be exposed to strong and changing currents. As well, as with many berthing facilities, dedicated berthing facilities for ferries must be able to accommodate changes in water level, typically relatively frequent and rapid changes in the case of facilities in locations subject to tides, and less frequent changes, perhaps seasonal, in the case of facilities on lakes or other non-tidal bodies of water.

Berthing structures of various designs are used as a means of transport of vehicles and passengers between a ferry or ship, and the shore, as well as for moorage for the ferry or ship. Rigid pilings are often used to support and anchor the berthing structure to the seabed thus providing a rigid berthing structure for convenient and reliable access from the shore to the ferry. A disadvantage of a rigid berthing structure is that it must be massive in order to absorb the berthing impact energy of a ship. The pilings used to anchor such berthing structures are susceptible to breakage if exposed to excessive transverse load from a berthing ship, said transverse load being applied to the piling remotely from the point of attachment of the piling to the seabed. Down time and cost for repair of the pilings may be significant. Damage to a fixed, rigid berthing structure may also result from severe weather conditions. A floating berth has the advantage that it will dynamically adjust to tidal conditions, however, such floating berths lack the rigidity of a fixed berth. Further, floating berths may still be susceptible to damage from berthing impact forces.

Accordingly, a berthing structure is required that is strong and capable of absorbing reasonably large impact forces from berthing ships as well as severe weather conditions, and that is sufficiently rigid so as to provide a consistent transport access between the shore and the ship or ferry. There have been several attempts to design such berthing structures or to design structural elements that can be used on a berth to achieve the energy absorbing goals.

U.S. Pat. No. 5,501,625 (Belinsky, 26 Mar. 1996) discloses a floating terminal for the offshore berthing of very large ships to facilitate transferring cargo between two ships. The floating terminal has a single point anchoring arrangement, consisting of a rigid arm connected to the ship bow and a swivel joint anchored to the sea bottom. A fendering system comprising at least two parallel gravity-type breasting dolphins are permanently attached to at least one of the port and starboard sides of the floating terminal. The specific dolphins employed in U.S. Pat. No. 5,501,625 are disclosed in U.S. Pat. No. 4,331,097 (Belinsky, 25 May 1982). U.S. Pat. No. 4,331,097 discloses a floating breasting dolphin having a pontoon for a ship's berth which absorbs the ship's impact energy by being pivoted and lifted from the surface of the water. A combination of mechanical devices for lifting the main part of the breasting dolphin relatively high off the water is provided. The pontoon of the dolphin is provided with a floodable compartment. Further floating terminal suffers from the disadvantage that an extended area is required to accommodate the movement of the large gravity type breasting dolphins as a ship berths at the floating terminal. Further, this design for a floating terminals suffers from the disadvantage that many moving parts are employed in the dolphin design.

U.S. Pat. No. 5,823,715 (Murdoch, 20 Apr. 1998) discloses a pier structure comprising a floating platform connected to a fixed point shoreline by a fixed position elevated roadway, said pier structure being capable of being rapidly deployed. The mooring system for the floating pierhead structure consists of: a single point mooring anchor system located at the bow of the structure; and four anchor legs located at the stern of the structure. The approachway to the floating pierhead structure is a fixed position, elevated roadway connecting the floating pierhead to the shoreline. The approachway is fabricated from individual spans supported by steel piles which are driven into the ocean floor. A bridge span is provided to connect the floating pierhead structure to the elevated roadway. This floating pierhead structure suffers from the disadvantages that the shoreline to pierhead connection does not dynamically adjust with tides, and further, the impact of a berthing ship must be absorbed by the floating pierhead structure itself.

U.S. Pat. No. 5,107,784 (Lacy, 28 Apr. 1992) discloses a docking system having a plurality of docking members connected end to end. Each docking member is anchored to the seabed. The docking members are lashed together end to end by cables or straps arranged in an X pattern. The space between the docking members is approximately six feet. A walkway of boards or metal extends the entire distance encompassed by the plurality of docking members, connected in a flexible manner to the top surface of the docking members. This docking system suffers from the disadvantage that while convenient for foot passenger travel along the dock, the docking system likely would not support heavier service vehicles or the like nor would it support the movement of vehicles onto the boats. Further, this docking system does not provide the required rigidity and stability for a ferry berth in that a boat impacting on the side of a docking member results in the movement of the docking member. If the applied force is too great, the anchor for that docking member will drag along the seabed and will need to be re-positioned.

U.S. Patent Application No. 2005/0277344 (Haun, filed 9 Jun. 2005) discloses a floating berth comprising a plurality of buoy components that are arranged in a linear fashion and protected by a fendering assembly which constitutes the breasting dolphins of a conventional fixed berth. The buoy components are generally suitable for water depth applications from approximately 100 feet to approximately 10,000 feet.

U.S. Pat. No. 6,470,820 (Wilkins, 28 Oct. 2002) discloses an interlocking connection system that connects modules via interconnecting fingers, male and female, and connector bodies in various states of relative motion between floating structures. The system consists of an arrangement of steel shafts, cams, and connector bodies which, together as male/female elements, can be used to manually lock and unlock floating modules or sections, such as pontoons. The system suffers from the disadvantage in that a number of moving parts must be constructed and aligned in the modules thus adding to the expense.

U.S. Pat. No. 3,695,046 (Torr, 3 Oct. 1972) discloses a fender arrangement for a jetty, said jetty comprising a generally rigid structure mounted to the seabed. Energy absorption by the fender is accomplished with elastomeric tension springs. These fenders suffer from the disadvantage that it is not possible to control the rebound forces of a ship off of the fender.

U.S. Pat. No. 4,697,538 (Day, 6 Oct. 1987) discloses a mooring arm structure having a first arm pivotally mounted to a dock and a second arm attached to the free end of the first arm. An airplane-type shock absorber is connected between the lower end of the second arm and a longitudinal midportion of the first arm. This mooring arm structure suffers from the disadvantage for present purposes that a mating mount for the free end of the second arm must be mounted on the docked vessel. The mooring arm structure of U.S. Pat. No. 4,697,538 is specifically adapted to moor fore and aft portions of a water vessel to an associated dock and is not adapted to accommodate the potentially large impact forces presented by an incoming ship or ferry.

U.S. Pat. No. 4,137,861 (Brummenaes, 6 Feb. 1979) discloses a method of mooring a very large ship at a ship's terminal, said method incorporating a fender having a hydraulic damping means and a cooperating pressure relieving and recoil preventing means. The method of U.S. Pat. No. 4,137,861, being adapted for the mooring of very large ships, is relatively complicated and expensive in that it incorporates a plurality of mooring winches for hauling the ship towards the terminal, and pressure monitoring means for monitoring the force of a ship against a fender, and a means for discharging the pressure when the pressure in the hydraulic damping means exceeds a predetermined limit.

U.S. Pat. No. 4,441,449 (Biaggi, 10 Apr. 1984) discloses a port ramp for access to a ship, having a first end supported by a quay and a second end supported by a float, the float being anchored by blocks to the seabed. The float is partially ballastable, that is, its buoyancy may be caused to vary by adjusting the ratio of water to air in the compartments of the float. In order to match the height of the ramp to the appropriate ship deck, the lie of the float supporting the ramp in the water must be adjusted by ballasting the float.

International Patent Application No. PCT/SE89/00297 (Ivarsson, filed 25 May 1999; International Publication No. WO 89/11564, published 30 Nov. 1989) discloses a ramp for a ferry berth, one end of said ramp being elastically connected to the quay and the other end, which is vertically adjustable relative to the water surface, is supported by a floating member. The floating member may be trimmed with a suitable ballast for level adjustment of the ramp. Hydraulic actuators are provided on the quay side end of the ramp for raising and lowering the ship end of the ramp. This ramp suffers from the disadvantage that significant strain is placed on the hydraulic actuators since the actuators must adjust a mass having a long lever arm. Further, the floating member is submerged at a depth intended to be sufficient to eliminate or at least reduce the effects of surface wave action. Accordingly, the floating member cannot serve as a means for service vehicles to access the sides of a vessel in the berth.

European Patent Application No. 87850148.5 (Oleborg, filed 30 Apr. 1987; Publication No. 0 245 227 A2, published 11 Nov. 1987) discloses a ramp spanning the distance between a quay and a pontoon float, the ramp being vertically pivotally connected to the quay. Hydraulic damping means are connected to the distal end of the ramp, the hydraulic damping means being designed to slow down the speed of pivot angle variations between the ramp and the pontoon float. This ramp suffers from the disadvantage that a connection between the shore and a berthed ship that automatically and passively adjusts to changes in water level is not provided.

International Patent Application No. PCT/SE88/00151 (Ivarsson, filed 28 Mar. 1988; International Publication No. WO 88/07605, published 6 Oct. 1988) discloses a loading ramp for a ferry, the loading ramp having two articulately interconnected sections, an inner section elastically connected to a quay, and an outer section, supported by floating members, the outer section supported above a horizontal ramp section. When a ferry lands at the loading ramp, the horizontal ramp section is lowered towards the ferry with hydraulic actuators. The ferry is provided with an end shelf designed to accept the horizontal section. The loading ramp suffers from the disadvantages that the ferry must be specially designed to accept the loading ramp and that only a single access ramp is provided.

U.S. Pat. No. 6,073,571 (Whitener, 13 Jun. 2000) discloses a mooring and ramp system for ferries. The ramp subsystem is carried on a float which is connected to the shore by a ramp hinged to the shore and to the float. A second ramp is hinged on the float and is adjustable to serve each deck of a multi-deck vessel in sequence. The mooring subsystem connects an end of the vessel to the float and allows lateral translation of the vessel relative to the float. A disadvantage of the mooring and ramp system is that the vessel must have a mating piece installed on the vessel to mate with the mooring system.

While various prior berth designs have some degree of isolated merit, none fully meets all objectives of a satisfactory berth for ferries and ships. An ideal improved berth would have a minimum number of moving parts, would provide a berthing platform that is strong and capable of absorbing severe weather conditions and reasonably large impact forces from berthing ships, would passively and automatically accommodate changes in water level, would minimize construction and repair times and costs, and would minimize environmental impact consistent with meeting the other objectives.

SUMMARY OF THE INVENTION

An objective of the present invention is to provide a berthing facility for bow/stern-loading ferries that would provide most if not all of the desired attributes referred to in the preceding paragraph, in a cost-effective manner.

In one aspect, the present invention is a berthing facility for use in moving vehicles between a bow/stern-loading ferry and a shore facility, the berthing facility comprising:

a) a floating pontoon having a bow/stern receiving section for receiving the bow or stern of a bow/stern-loading ferry, and a projecting finger against which may lie a side of a ferry having its bow or stern at the receiving section;

b) means for pivotally securing the bow/stern receiving section wherein the pontoon may pivot about a pivot axis in the vicinity of the bow/stern receiving section;

c) means for maintaining the projecting finger and thus the pontoon in a preferred pivotal orientation wherein the means resiliently resists lateral movement of the projecting finger from the preferred orientation;

d) a ramp having a shore end and a pontoon end, and having a vehicle pathway wherein vehicles may be driven on the vehicle pathway along the ramp;

e) means at a shore facility for pivotally supporting the ramp shore end; and f) means at the pontoon in the vicinity of the bow/stern receiving section for pivotally supporting the ramp pontoon end;

wherein, in use, force associated with a ferry impacting the projecting finger during a docking maneuver may be absorbed through lateral movement of the projecting finger; the ramp may pivot relative to the shore facility about a generally horizontal axis and relative to the pontoon about another generally horizontal axis so as to accommodate changes in water level relative to the shore facility, and the ramp may be used to convey vehicles between a shore facility and a bow/stern-loading ferry having its bow or stern at the receiving section.

Preferably, the means for pivotally securing the bow/stern receiving section is a pylon assembly comprising: a generally vertically oriented pylon, mounted under the water to a horizontally extending pylon base attached to a plurality of piles driven into the ground under the water, the pylon sized and configured to project above the water's surface at the highest expected water level; and a pylon opening in the pontoon, having inner walls within which the pylon is disposed and having at least one energy absorbing buffer attached to the inner walls for absorbing forces associated with non-pivotal relative movement as between the pylon and the pontoon.

Preferably, the means for maintaining the projecting finger in the preferred pivotal orientation comprises an anchor assembly comprising: a chain securing means mounted to the projecting finger (preferably proximate the distal end of the projecting finger, being the end of the projecting finger furthest from the bow/stern receiving section); at least two anchor means (each preferably a gravity anchor or a rock socket), a first anchor means disposed at the ground under the water off one side of the projecting finger and a second anchor means disposed at the ground under the water off the other side of the projecting finger; a first chain having one end of its operative length connected to the first anchor means and having the other end secured in the chain securing means; and a second chain having one end of its operative length connected to the second anchor means and having the other end secured in the chain securing means. Preferably, the anchor means are located relative to the chain securing means such that the chains, when viewed from above, run substantially perpendicularly relative to the longitudinal axis of the projecting finger. Preferably, for redundancy and ease of maintenance, there are additional combinations of anchor means and chains connected one to the other and secured in the chain securing means.

Preferably, the chain securing means comprises a generally vertically disposed chain post having: chain keepers at its upper end for engaging the links of the chains; and a hawse at its lower end through which the chains exit the chain securing means, wherein the hawse is submerged to a sufficient depth to provide vertical clearance between the chains and a ferry using the berthing facility. Also preferably, to provide a resilient mount that will absorb some of force of the chain load, particularly when the chain catenary is taken up and the chain becomes tight, the chain post is suspended within a chain post shaft between the top and bottom of the pontoon, within which the chain post is disposed with a plurality of rubber bumpers, each attached to an inner wall of the shaft and to the chain post, so as to resiliently suspend the chain post within the shaft.

To accommodate ferries having two pairs of vehicle access ports, a lower pair of vehicle access ports and an upper pair of vehicle access ports, the ramp preferably has two vehicle pathways, an upper vehicle pathway and a lower vehicle pathway, with the vehicle pathways in a fixed spaced-apart relationship. Preferably, to provide vehicle path continuity between the lower vehicle pathway and a lower vehicle access port, and to accommodate different ferries having different vertical distances between their upper and lower access ports so as to provide vehicle path continuity between the upper vehicle pathway and an upper vehicle access port:

a) a lower level apron is pivotally attached to the ramp pontoon end in the vicinity of the lower vehicle pathway, wherein the pivotal orientation of the lower level apron relative to the ramp is controllable, preferably by means of one or more hydraulic rams attached between the ramp and the lower level apron;

b) an upper level apron, having a proximal end and a distal end, is pivotally attached at its proximal end to the ramp pontoon end in the vicinity of the upper vehicle pathway, wherein the pivotal orientation of the upper level apron relative to the ramp is controllable, preferably by means of one or more hydraulic rams attached between the ramp and the upper level apron; and c) an articulating apron is pivotally connected to the distal end of the upper level apron, wherein the pivotal orientation of the articulating apron relative to the upper level apron is controllable, preferably by means of one or more hydraulic rams attached. The articulating apron comprises two sub-aprons pivotally connected one to the other. Preferably the pivotal orientation of one sub-apron relative to the other sub-apron is controllable, preferably by means of one or more hydraulic rams attached between the sub-aprons.

The three sections of upper apron are preferably provided on the berthing facility. The upper level apron directly pivotally connected to the ramp and supported by hydraulic rams on the outboard end, is relatively long and provides the function of adjusting for height differences between upper and lower car decks on the various ferry types. The adjustable secondary upper level apron eliminates the requirement of lifting the entire length of an upper level ramp, as on conventional designs for two-level ferry berthing facilities.

Preferably, the berthing facility is provided with a two-lane two-level truss-bridge-style vehicle ramp allowing two-level loading with support on a pontoon. This design uses a steel deck plate for both levels of the vehicle ramp with side "H" member truss diagonals and verticals (lacing) to form a strong and rigid span. Such a structural arrangement can easily and economically be used to achieve relatively long spans which are desirable for maintaining gentle slopes for vehicles and passengers at extreme tide conditions. The overall box section provided by the two-level truss ramp is torsionally rigid and strong allowing use of a lift system at the pontoon end, for adjustability to suit different ship freeboards, which effectively provides a single point of end rotation. The latter feature accommodates wave and differential loading movements of the pontoon without inducing significant twisting stresses into the ramp.

To accommodate different ferries having vehicle access ports at different heights above the water surface, preferably there is a means for adjusting the vertical disposition of the ramp pontoon end relative to the pontoon so that the ramp pontoon end may be raised or lowered. Preferably, the means for adjusting the vertical disposition of the ramp pontoon end comprises two pairs of cross-connected ramp lift hydraulic cylinders having lower ends connected to the pontoon and upper ends connected to the ramp in the vicinity of the ramp pontoon end.

To achieve ramp offshore end lift that behaves as if it is a single point of lift as described above, a system of cross connected hydraulic cylinders is used in the described embodiment of the invention. Two pairs of lift cylinders or jacks are provided on each side of the ramp. The outer cylinder on one side is piped in common with the outer cylinder on the other side of the ramp. Similarly the inner cylinder on one side is in a common circuit with the inner cylinder on the other side. The cylinder end pins are all on a common transverse axis of rotation so changes in ramp angle to accommodate tidal movement do not require any extension or retraction of the cylinders. In the event that there is transverse rolling of the pontoon in response to waves or differential loading, hydraulic fluid is passively pumped from the cylinders on one side of the ramp to the corresponding cylinders on the other, maintaining a constant vertical distance of the ramp off the deck of the pontoon at the longitudinal centerline.

Preferably, the berthing facility uses self-contained hydraulic dampers to absorb and dissipate vessel impact energy. The hydraulic dampers control forces into the floating structure while absorbing the required ship impact energy absorption, and subsequently controlling rebound forces. Employment of the hydraulic damper concept for a berthing ferry vessel requires determination of the effective kinetic energy of the vessel at the point of impact with the damper. This kinetic energy must be absorbed in some way to bring the vessel to rest in the selected direction of motion. The kinetic energy of the vessel is a function of its mass, the shape of the ship which adds associated water mass traveling with the hull, the point of impact with the hull with respect to its center of gravity and the speed of impact. The largest influence on the design kinetic energy is the speed at impact since the energy is a function of the square of the speed. Once a requirement for kinetic energy absorption has been established, the designer then has to select the amount of travel or displacement that the damper can have. This is often dictated by geometry constraints of an individual ferry berth. When the maximum displacement is known this will yield the average resistance required. Conversely, if the limitation is maximum reaction force, the minimum stroke may be found from the same mathematical product. Determination of damper cylinder diameter is then initiated by choosing a design operating pressure. However, the resistance will usually be a function of resistance of driving oil through an orifice i.e. viscous energy dissipation, and gas 'spring' resistance. The latter is a gas charge behind displaced oil, which will tend to cause the damper to return back to its original position after a impact event. The gas charge generally behaves like a spring in that energy absorbed is returned back as rebound, though the rebound is dampened in that the hydraulic oil must pass through the orifice. Return force is something that the designer has to select. Coupled with this there is the selection of accumulator volume. A large volume will mean that gas pressure resistance is relatively constant with displacement i.e. a low spring constant. A small volume will give a steep rise in gas pressure with displacement (a high spring constant). The profile of gas charge resistance must be added to the damping resistance plot of the oil passing through the orifice (oil dissipation pressure may not be flat, depending on the type or orifice control that is used). Selection of diameter for the main damper cylinder is then an iterative process of trying combinations of damper bore with accumulator volume to select a combination which gives the required energy absorption, within allowable limits of deflection (stroke) and maximum pressure.

Preferably, a plurality of fenders is arrayed about the periphery of the pontoon for absorbing vessel impact forces, each fender comprising: a swing arm, having one end pivotally attached to the pontoon; a fender panel (being the portion of the fender intended to contact a vessel impacting or laying against the fender) attached to an end of the swing arm opposite the end attached to the pontoon; and a hydraulic damper having one end attached to the pontoon and the other end attached to the swing arm, and comprising: a ram having a piston and a cylinder; an accumulator, having a nitrogen charge chamber and a hydraulic oil chamber, and separating means (preferably a flexible diaphragm or floating piston or other suitable separating means), moveable responsive to pressure differentials, for separating the nitrogen charge and hydraulic oil; a conduit providing fluid communication between the interior of the cylinder and the hydraulic oil chamber; and a restricting orifice in line between the cylinder and the hydraulic oil chamber for restricting flow of hydraulic oil as between them; wherein, when a vessel impacts the fender panel with sufficient force, the ram is compressed forcing hydraulic fluid from the cylinder into the hydraulic oil chamber in the accumulator via the restricting orifice, thus compressing the nitrogen charge.

Preferably, the distal end of the projecting finger of the pontoon is configured to be used as a turning dolphin for vessels approaching or departing from the berthing facility, in that the distal end is curved and has turning fenders arrayed about its curved periphery. Preferably, each of the turning fenders comprises: a swing arm, a fender panel and a hydraulic damper, all generally configured and interconnected as described above with respect to the fenders arrayed about the periphery of the pontoon.

Preferably, for guiding the end of a ferry into a desired position for loading and unloading, and for absorbing vessel impacts, the berthing facility includes two wingwalls resiliently flexibly connected to the pontoon in the vicinity of the receiving section, the wingwalls spaced apart sufficiently to permit vehicles entering or exiting a ferry to pass between them and angled relative to each other to cause the end of an incoming ferry to be essentially centered as between the wingwalls. Preferably, a hydraulic damper is connected between each wingwall and the pontoon, the hydraulic damper generally as described above with respect to the fenders arrayed about the periphery of the pontoon.

The berthing facility provides a floating concrete pontoon to support a vehicle ramp and fenders. The floating pontoon automatically follows changes in water level without the need for expenditure of lift energy for adjustment by operator or electronic control means. Accordingly, when ships are tied up in the berthing facility there is an essentially fixed relationship between the deck levels of the ship and the pontoon of the berthing facility. Components of the floating berthing facility may be fabricated off-site thus reducing construction time. Further, problems with ground conditions can be minimized since fewer piles are required for positioning of the berthing facility. The overall structure of the berthing facility is stable in the sense that the floating pontoon of the berthing facility is able to accommodate wave action, differential loading movements, and ship impact forces, and the pontoon is torsionally rigid in the sense that there are no swivel joints between concrete modules that are joined together to form the pontoon. Twisting of the pontoon of the berthing facility is resisted by having torsional strength designed into the modules of the pontoon and the joints between the modules.

Conveniently, the pontoon permits service vehicle access along side a ship laying against the pontoon. Accordingly, service functions can be performed on the exterior of the ship, such as replacement of life rafts or erection of scaffolding to allow painting or repair, while maintaining a constant relationship between the ship and the service vehicles during tidal movement.

By using a floating pontoon in the berthing facility, much of the berthing facility is inherently isolated from the ground providing a high degree of survivability during seismic events. Preferably, the pontoon is made of concrete. Preferably, the pontoon is constructed of prestressed, concrete utilizing high strength steel strand for reinforcement for strengthening thus providing a structure which is both strong and flexible. Concrete pontoons of other configurations or pontoons made from other materials may also be used. Preferably, the pontoon is made of a plurality of concrete modules joined one to another, wherein: each of two modules joined one to the other has a join end having: a circumferential flange having a planar face, a concavity surrounded by the flange, an internal work chamber, and a plurality of bores running from the work chamber to the flange face; and the join between two modules comprises: a plurality of nuts, a plurality of threadbars, each running from the work chamber of one module to the work chamber of the other module via a bore in the one module and an aligned bore in the other module, and each having a nut threaded on each end within a work chamber, the nuts tightened so as to tension the threadbars, and a cast-in-place cement-grout key spanning the two concavities, wherein the threadbar/nuts combinations resist tension across the join, and the cast-in-place key impedes relative shearing and rotational movement as between the modules. The modules may be separated for repair or replacement.

Preferably, the bores are the inner bores of pipes cast in the modules. Also preferably, each concavity has substantially rectangular inner walls; and the concavities are substantially aligned when the modules are aligned for joining one to the other, whereby the cast-in-place key is a substantially rectangular parallelepiped. However, it will be clear that the concavities could be of any configuration suitable for forming a cast-in-place key having the desired shearing-and-rotational-movement-resisting attributes. Preferably, the join ends of the modules have complementary sockets and pins for use in aligning the modules during assembly of the pontoon.

In another aspect, the invention is a method for attaching two pontoon modules together while afloat, at least one of the modules having a gasket material bonded to its flange, the method having the steps of: drawing the modules into alignment; inserting threadbars into the bores via one or the other work chamber such that the threadbars run from one work chamber to the other work chamber via a bore in one module and an aligned bore in the other module; threading a nut onto each end of each threadbar; compressing the gasket material between the flanges sufficiently to prevent the water in which the modules are floating from flowing into a cavity defined by the two concavities; dewatering the cavity; once the cavity is dewatered, placing cement grout into the cavity; and tensioning the threadbars by tightening the nuts.

Frequently, the primary environmental concern in construction of a berth is the damage caused to fish from pile driving hammers. The berthing facility of the present invention reduces the number of piles required compared to a conventional dedicated ferry berthing facility, thus reducing the damage to the footprint seabed and the environmental impact.

BRIEF DESCRIPTION OF THE DRAWINGS

The present invention will be further understood from the following description with references to the drawings, in which all views are schematic and may not be to scale.

Figure 1:
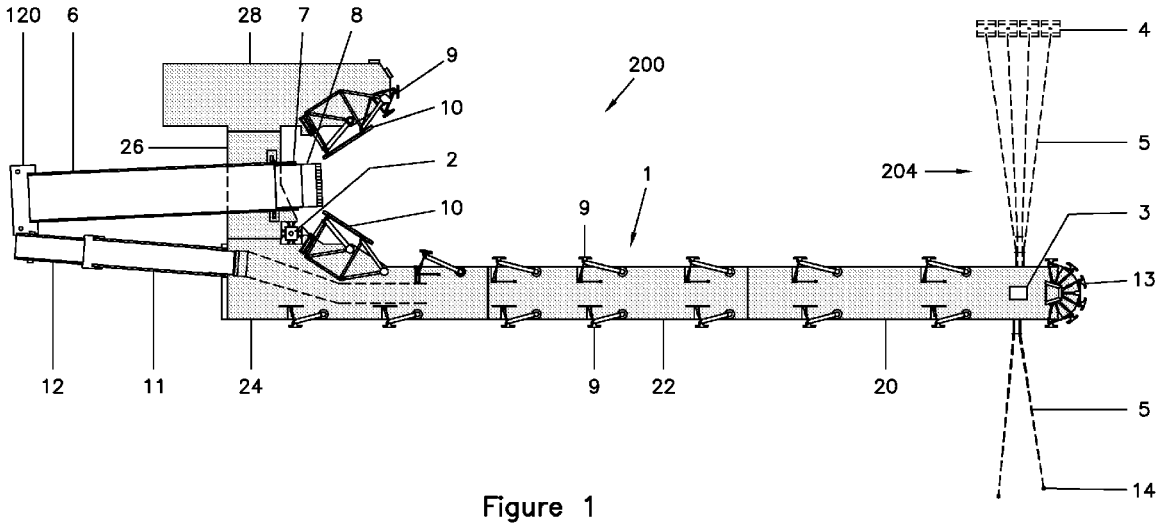
FIG. 1, in a plan view, illustrates a floating pontoon berthing facility for ferries and ships in accordance with an embodiment of the present invention.

In the drawings, preferred embodiments of the floating pontoon berthing facility for ferries and ships and related equipment according to the invention are illustrated by way of example. It is to be expressly understood that the description and drawings are only for the purpose of illustration and as an aid to understanding, and are not intended to be a constraint on the limits of the invention.

DETAILED DESCRIPTION

Figure 2:
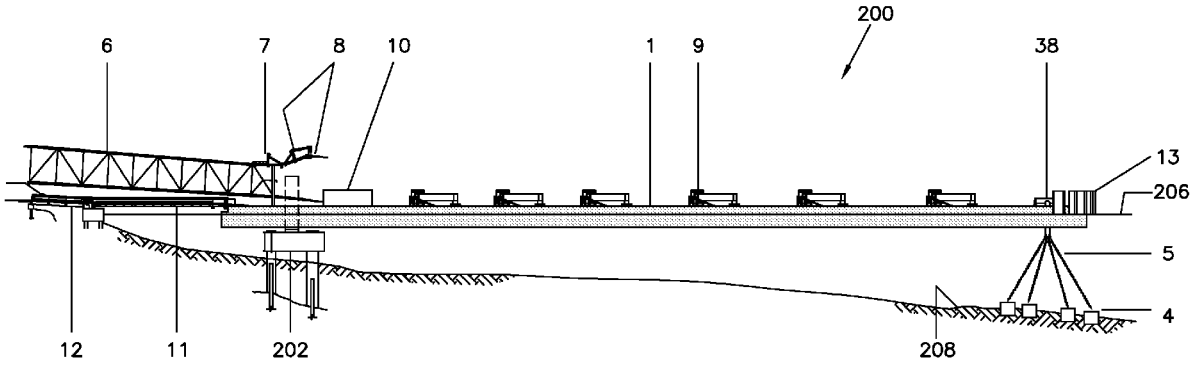
FIG. 2, in a side view, illustrates the berthing facility of FIG. 1.

The embodiment described in what follows and shown schematically in the drawings is suitable for accommodating bow/stern-loading ferries having a length of roughly 550 feet; a gross tonnage of roughly 19,000 tons; and two pairs of bow/stern vehicle access ports, an upper pair and a lower pair. A typical such ferry would have a capacity of roughly 470 automobiles, and roughly 2,100 passengers and crew. In the drawings, the water surface is identified by reference number 206 and the seabed is identified by reference number 208. As shown in FIGS. 1 and 2, a berthing facility 200 includes a generally J-shaped floating pontoon 1, a pylon assembly 202 securing the near-shore end of the pontoon 1; an anchoring assembly 204 securing the outer end of the pontoon 1; and a vehicle loading and unloading ramp 6 and a service ramp span 11, each of the ramp 6 and span 11 running from the shore to the near-shore end of the pontoon 1. The distal end of the pontoon 1 is curved and configured to be a turning dolphin 13. Mounted on the pontoon there are: thirteen line fenders 9; four tandem fenders 16 (one proximate the end of the "hook" of the "J" and three at the turning dolphin 13); and two wing walls 10.

The pontoon 1 comprises five interconnected pontoon modules, an offshore end module 20, a main pier module 22, a first wingwall module 24, a ramp module 26, and a second wingwall module 28, the modules being joined together as discussed below.

The offshore end module 20 is of generally rectangular shape with a rounded distal end comprising the turning dolphin 13. The proximal end of the offshore end module 20 is configured for attachment with the distal end of the generally rectangular main pier module 22. The proximal end of the main pier module 22 is configured for attachment with the distal end of the first wingwall module 24. Although the first wingwall module 24 is of a generally rectangular structure, the proximal inner wall of the first wingwall module 24 is contoured to receive the bow or stern, as the case may be, of a ferry. The offshore end module 20, the main pier module 22 and the first wingwall module 24 are joined together end-to-end to form a projecting finger. The first end of the generally rectangular ramp module 26 is joined to the proximal end of the first wingwall module 24 such that the ramp module 26 projects perpendicularly to the longitudinal axis of the projecting finger comprising the offshore end module 20, the main pier module 22 and the first wingwall module 24. The second end of the ramp module 26 is joined to the proximal end of the generally rectangular second wingwall module 28 such that the second wingwall module 28 lies generally parallel to the projecting finger. The distal end of the first wingwall module 24 is rounded. When assembled, the offshore end module 20, the main pier module 22, the first wingwall module 24, the ramp module 26, and the second wingwall module 28 resemble a J-shaped structure, with the "hook" of the "J" forming a recess dimensioned and configured to receive the bow or stern of a ferry.

The pontoon 1 is secured in its desired location with a combination of a pylon assembly 202 at the shoreward end and an anchor assembly 204 proximate the distal end of the projecting finger.

Figure 3:
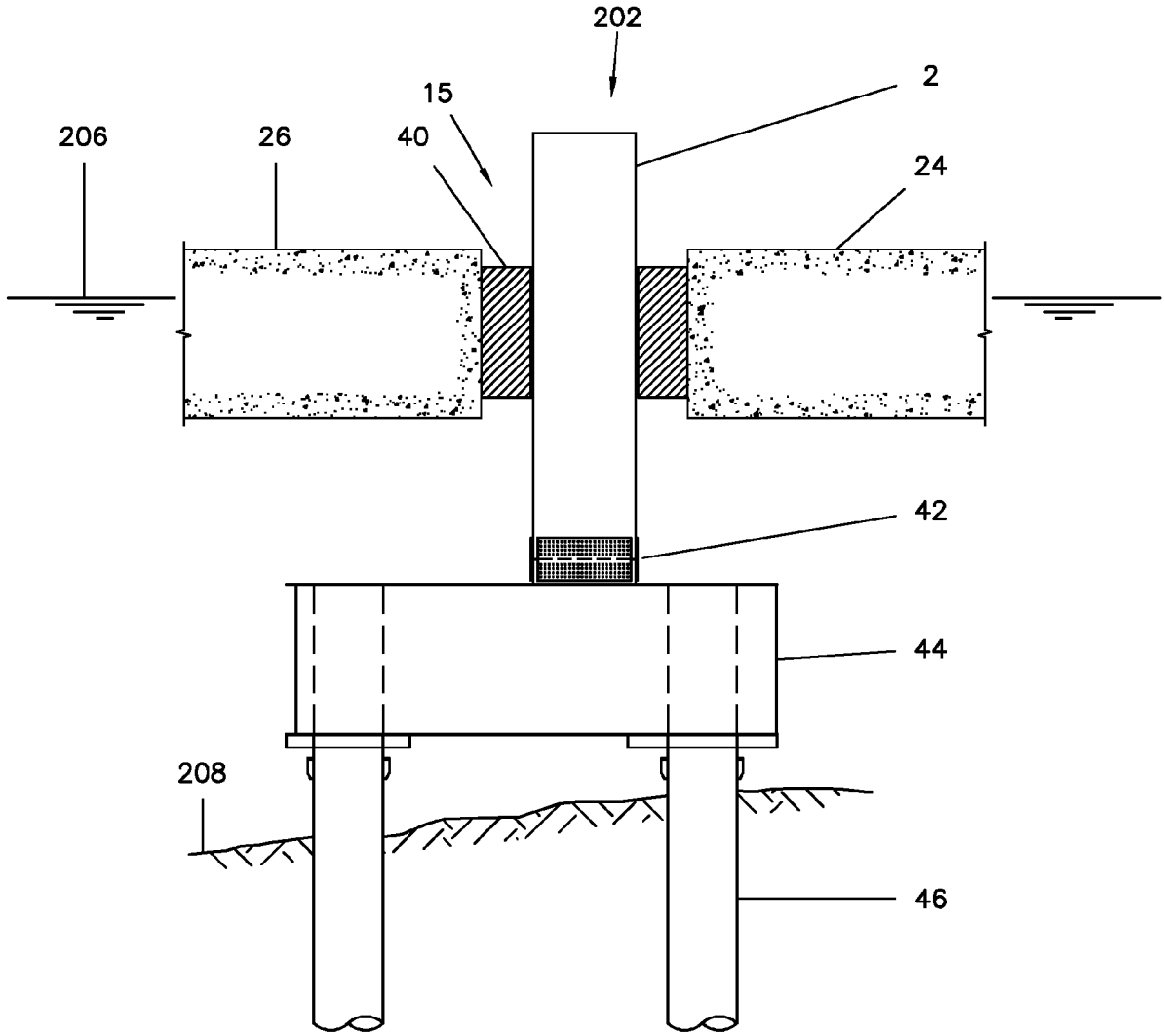
FIG. 3, in an side view, illustrates the pylon assembly of the berthing facility of FIG. 1.

Referring to FIGS. 1 and 3, the shoreward end of the pontoon 1 is fixed in place by a pylon assembly 202 comprising: a vertical pylon 2 fixed to the ocean floor; and a pylon opening 15 in the pontoon 1, through which the pylon 2 projects. The lower end of the mooring pylon 2 is secured by bolts into a collar 42 fixed to a large submerged pylon base 44. The pylon base 44 is supported by and fixed to large diameter pipe piles 46, driven into and fixed to the seabed in a conventional manner. In particular, the pipe piles 46 are drilled, socketed and filled with concrete. The socketed piles 46 are then cut off at the appropriate elevation. Using a plurality of piles 46 to support the pylon 2 rather than merely driving a single large pile to act as the pylon 2, results in a stronger pylon assembly 202. As well, as driven piles cannot be reliably precisely located because of inconsistencies in the material underlying the seabed, the configuration of a plurality of piles 46 topped by a pylon base 44 that supports the pylon 2, permits the pylon to be located relatively precisely, as the pylon 2 can essentially be located anywhere on the pylon base 44. Being able to precisely locate the pylon 2 is desirable as this permits manufacture of the other components of the berthing facility 200 prior to, or concurrently with, placement of the pylon 2 and supporting structures. The pylon 2 is sized to project from the water surface at the highest water expected in the location.

The pylon opening 15 is situated at the joint between the first wingwall module 24 and the ramp module 26. This location permits assembly of the pontoon 1 after the pylon 2 is in place and later disassembly for maintenance or repair. Referring to FIG. 3, full depth energy absorbing rubber buffers or fenders 40, such as Sumitomo™ or Fentek™ bumpers, fixed to the walls of the pylon opening 15, slidingly bear on all sides of the mooring pylon 2 on all sides. In addition to being designed to absorb the usual operating forces (e.g. vessel impact, wind loading etc.), the rubber bumpers 40 are also preferably designed to withstand expected earthquake amplitudes of motion. As the tide rises and falls, the pontoon modules float following the changing water level, however, the pipe piles 46, the mooring pylon base 44, and the mooring pylon 2 remain fixed in place. The rubber buffers 40 allow the pontoon modules to move either down or up on the mooring pylon 2 with the tide. Sliding friction between the rubber buffers 40 and the steel pylon 2 is reduced by attaching a readily replaceable low friction plastic (UHMW) layer to the steel pylon 2.

In the embodiment shown in FIG. 1, the distal end of the projecting finger of the pontoon 1 is held in position by the anchor assembly 204 comprising; six large-diameter chains 5, each chain 5 connected at one end to the chain post (or mooring post) 38, and at the other end to one of six seabed anchors, being four gravity anchors 4 and two rock sockets 14. For the embodiment described herein, a suitable gravity anchor 4 is a sixty ton concrete anchor buried 3 meters deep into the seabed. The suitability of gravity anchors 4, rock sockets 14 or some other type of anchor system for a particular installation depends on a variety of factors, including the nature of the seabed, and is for the designer of the particular installation to determine.

Figure 4:
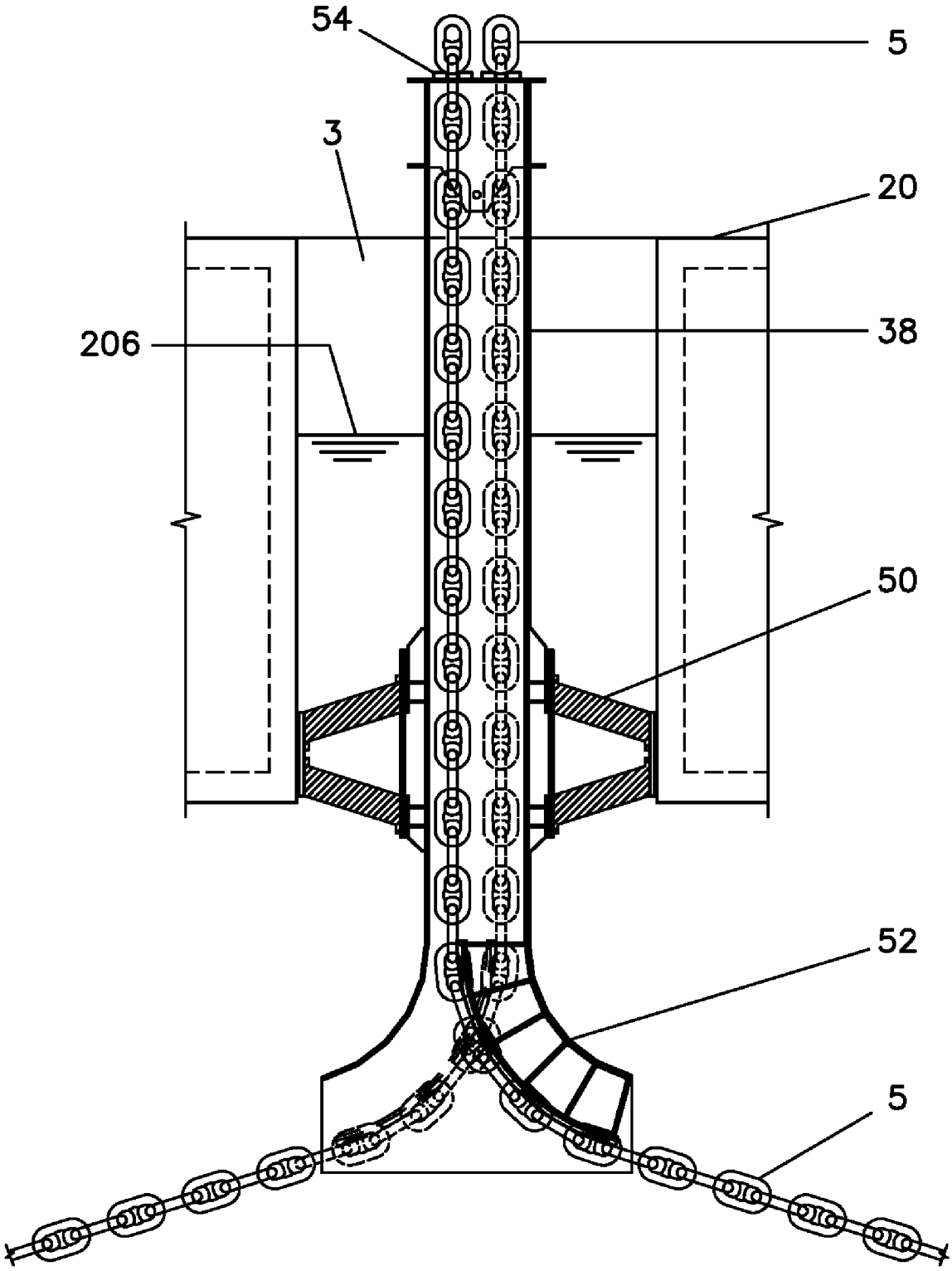
FIG. 4, in cross-sectional view, illustrates the chain post of the berthing facility of FIG. 1.

Referring to FIG. 4, the chain post 38 is suspended within a rectangular opening 3 near the distal end of the offshore end module 20 by energy absorbing rubber buffers or fenders 50, such as Sumitomo™ or Fentek™ bumpers, secured to the inner wall of the rectangular opening 3. The mooring post 38 has a generally rectangular cross-section, however, the lower end of the mooring post 38 is provided with generally horizontal curved chain exit guides 52. The chain exit guides 52 provide a smooth, curved sliding surface so that the chains 5 can be led out of the top of the mooring post 38 where they can be adjusted by a crane or jack thereby facilitating adjustment or replacement of the heavy mooring chains when required. This flaring of the lower end of the chain post 38 (also referred to as a "hawse"), also avoids a so-called "hard spot", that is, a sharp turn or projection against which the chains 5 would tend to wear. The chain post 38 projects down into the water so as to locate the chain exit guides 52 of the chain post 38 at a depth sufficient to provide vertical clearance between the chains and a ferry approaching, or in, the berthing facility 200, when the chains are under load. Steel-plate chain keepers 54 located at the top of the mooring post 38 are used to engage links of the mooring chains 5 and fix the mooring chains 5 to the mooring post 38. The mooring chains 5 are an array of large diameter chains secured to individual anchors for ease of handling and redundancy.

As shown in FIG. 1, there are two sets of anchors, one set comprising the gravity anchors 4, disposed on one side of the projecting finger and the other set comprising the rock sockets 14 disposed on the other side of the projecting finger, such that, when viewed from above, the chains 5 run essentially perpendicularly relative to the longitudinal axis of the projecting finger, on each side of the projecting finger. The placement and relative number of the gravity anchors 4 and the rock sockets 14 in the embodiment shown in the drawings, reflects the seabed conditions of an actual installation in which the two rock sockets 14 are considered to provide an anchoring effect essentially equivalent to that of the four gravity anchors 4. Although in some installations it may not be necessary to have an essentially equivalent anchor effect on each side of the projecting finger, in most installations this will be desirable as the projecting finger may conceivably be subject to storm-wind loading from any direction. In the case of the described embodiment, it is particularly useful to have essentially equivalent anchor effect on each side of the projecting finger, as the projecting finger is configured to receive vessels on either side (the projecting finger has line fenders 8 on each side), and thus may be subject to vessel impact on either side.

At rest, that is without appreciable loading on the chains 5 due to force against the pontoon 1, there is some slack in the chains 5, both to allow for vertical movement of the pontoon 1 with changing water levels and to permit some lateral movement of the projecting finger (that is movement of the projecting finger in a direction generally perpendicular to the longitudinal axis of the projecting finger), in response to a force applied against the projecting finger (e.g. due to vessel impact, wind or current loading etc.) When viewed from the side, at rest, the sections of each chain between the chain post 38 and the seabed lies in a curve (referred to as a catenary). The shape of the curve is variable and dependent on several factors including the depth of water, weight of chain etc., but it can be said that when at rest, each chain is curved, and when under load the curve decreases such that at a theoretical maximum load the lie of the chain would approximate a straight line. In the result, the opposed-anchors configuration: tends to maintain the projecting finger in an at-rest position at which the load on the set of chains on one side of the projecting finger balances the load on the set of chains on the other side of the projecting finger, and resiliently resists lateral movement of the projecting finger from this at-rest position. The at-rest lateral position of the projecting finger; the resistance to lateral movement provided by the anchor assembly; and the range of lateral movement of the pontoon 1 permitted by the anchor assembly 204, may be altered by adjusting the lengths of the chains 5 between the lower end of the chain post 38, and the respective gravity anchors 4 and rock sockets 14. Adjustments to the lengths of a chain between the lower end of the chain post 38, and the respective gravity anchor 4 or rock socket 14, may be made by disengaging from the chain keeper 54 the link of the chain 5 engaged with the chain keeper 54 and engaging another link of the chain 5 with the chain keeper 54. As referred to above, such adjustments to a chain 5 typically require the use of a crane (preferably a mobile crane suitable for travel on the pontoon 1), or a jack, to support the chain 5.

The combination of the pylon assembly 202 (which permits pivoting of the pontoon 1 about the pylon 2) and the anchor assembly 204 (which permits restrained lateral movement of the projecting finger) provides a semi-rigid fixity at the shore end of the pontoon 1 giving an essentially positionally stable interface between a ferry in the berthing facility 200 and the ramp 6, while the projecting finger behaves much like a floating lead with flexible restraint. The shoreward mooring pylon 2 forms a pivot point about which the pontoon 1 may pivot within the bounds permitted by the anchor assembly. In the described embodiment, the maximum intended lateral movement of the distal end of the projecting finger is approximately 12 feet each way from an at-rest position, under full expected impact or wind load. Under most tide conditions and vessel docking maneuvers, the lateral movement will be less. Flexibility and capacity for relatively large lateral movement at the distal end of the projecting finger are desirable to dissipate berthing impact forces between a ferry and the pontoon 1.

As discussed above, the chains 5 exit the chain post 38 at a location below the water surface so as to ensure sufficient vertical clearance between the chains 5 and vessels using the berthing facility 200. By contrast, the loci of the forces on the pontoon 1 associated with a vessel (primarily impact and wind loading), will tend to be on the upper side of the pontoon 1 as this is where the line fenders 9, and mooring bollards, cleats and/or winches (i.e. the members and/or devices on the pontoon 1 to which the lines used to secure a vessel to the pontoon 1 are attached, not shown). In the result, there is a vertical displacement between the expected loci of lateral forces expected to be applied to the pontoon 1 and the locus (i.e. the lower end of the chain post 38) at which resistance to lateral movement of the pontoon 1 is effected. This vertical displacement results in a torque being applied to the pontoon 1 essentially along the longitudinal axis of the projecting finger, when a lateral force is applied to the projecting finger. The pontoon 1 must be sufficiently strong to withstand this torque. Further, in terms of resistance to lateral movement, the projecting finger is only supported at each end (i.e. by the pylon assembly at one end and by the anchor assembly 204 at the other end). The pontoon 1 must be sufficiently strong for the unsupported span of the projecting finger to withstand the expected lateral forces along its length.

Each pontoon module is preferably constructed from high-quality reinforced concrete formed over expanded-polystyrene (e.g. styrofoam™) billets 30 (see FIGS. 6*a* and 6*b*), the billets providing positive buoyancy to the pontoon modules. Each concrete module is strengthened by pre-stressing using the technique of post-tensioning. The concrete module is cast with high strength steel strand in tubes. When the concrete has reached sufficient strength the strand is stretched and locked off against bearing plates cast in the concrete. The strand is then bonded to the structure by a cement grout pumped into the tubes. For the embodiment described herein, the concrete wall thickness of the side walls range in thickness from 250 mm (10 inches) to 375 mm (15 inches). The thickness of the deck and base slabs of the concrete modules vary between 220 mm (6.7 inches) and 275 mm (10.8 inches). On the deck of the pontoon 1, service vehicle movement is accommodated by a 4.35 m (14.26 foot) wide roadway that runs along the center of decks of the pontoon modules.

Figure 6A:
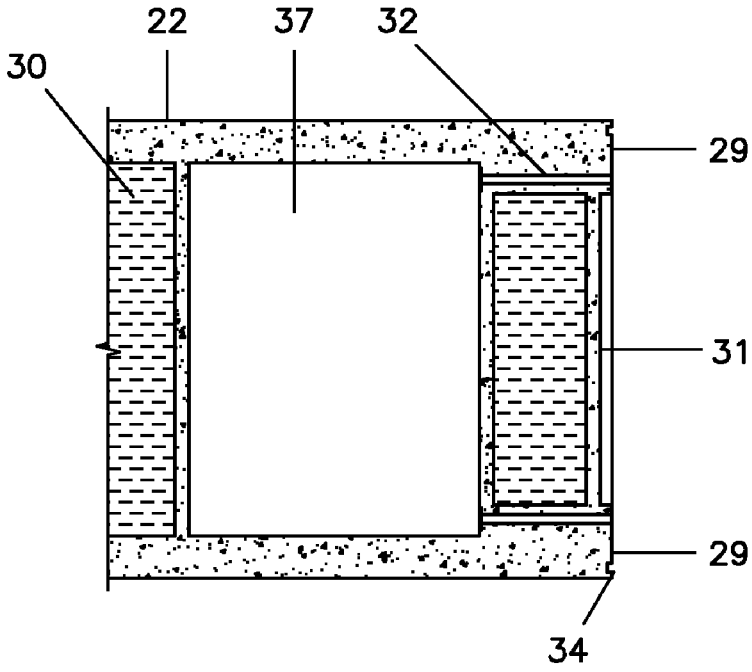
FIG. 6*a*, in a plan cross-sectional view, illustrates the end of a pontoon module of the berthing facility of FIG. 1, used in connecting the module to another such module.
Figure 6B:
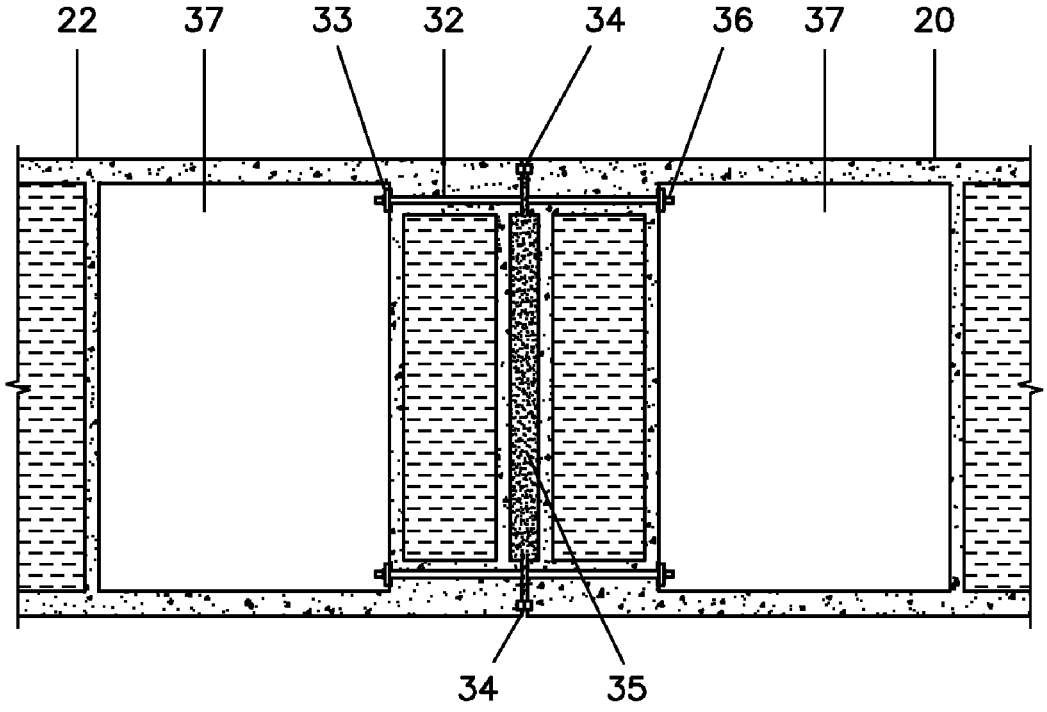
FIG. 6*b*, in elevational cross-sectional view, illustrates the join of two such pontoon modules as shown in FIG. 6*a*.

The pontoon modules are preferably fabricated off-site; once afloat they may be towed to the location of the berthing facility 200. The modules are joined one to the other once afloat, either at the location of the berthing facility 200 or at some other location as is most convenient for construction. FIGS. 6*a* and 6*b* show the join between the offshore end module 20 and the main pier module 22, which join is typical of the join between the each of the adjacent modules. As shown in FIG. 6*b*, the features of each module associated with the module-to-module attachment means include: a work chamber 37; a thickened end flange 29 surrounding and defining a rectangular concavity 31; a plurality of cast-in steel tubes 32 running from the work chamber 37 to the face of the flange 29; and a plurality of sockets/pins 34 cast in the face of the flange 29 for mating with complementary sockets/pins in the other module for temporarily holding the two modules in the desired alignment during the attachment procedure. Prior to a module being placed in the water: the steel tubes 32 are blocked with removeable plugs to prevent the ingress of water into the work chamber 37; and a gasket (not shown) made of a suitable material (such as neoprene) and having openings for the socket/pins 34 and the ends of the steel tubes 32, is bonded to the face of the flange 29 (preferably using a suitable glue).

To attach one module to another, the two modules are winched together while afloat and are aligned using the mating sockets/pins 34 of the two modules. Once the modules are aligned, the steel tubes 32 of one module align with the corresponding steel tubes 32 of the other module. Once the modules have been drawn together sufficiently so that the two gaskets abut one another so as to impede the flow of water into the steel tubes 32 that are below sea level, the removeable plugs are removed and steel threadbars 36 (preferably with plastic sheathing) are inserted into the steel tubes from one or the other of the work chambers 37. Access to each of the work chambers 37 is via a manhole (not shown) at the top of the work chamber 37. An associated manhole cover (also not shown) is used to close the manhole as desired. A nut 33 (and associated washer or washer plate, as required), is threaded on to each end of each threadbar 36.

When two modules are aligned for attachment, the rectangular concavity 31 of one module is aligned with the rectangular concavity 31 of the other module, such that the two rectangular concavities 31 define a rectangular cavity at the interface between the two modules. Once the modules have been drawn together sufficiently so that the two gaskets prevent flow of water from the surrounding water into the interface cavity (if necessary to perfect the seal provided by the gaskets, the threadbar 36/nut 33 combinations may be used to compress the gaskets), the water that was trapped in the interface cavity when the modules were brought together is removed, preferably by being drawn from the interface cavity with a suitable pump. After the interface cavity has been de-watered, cement grout is poured into the interface cavity. When the grout reaches sufficient strength, the nuts 33 are tightened to put the threadbars 36 under tension, to provide a compression force across the interface and thus provide joint rigidity. The threadbar 36/nut 33 combinations resist tension across the joint between the modules, and the grout forms a cast-in-place spline or joint key 35 that impedes relative shearing and rotational movement as between the modules.

Figure 10A:
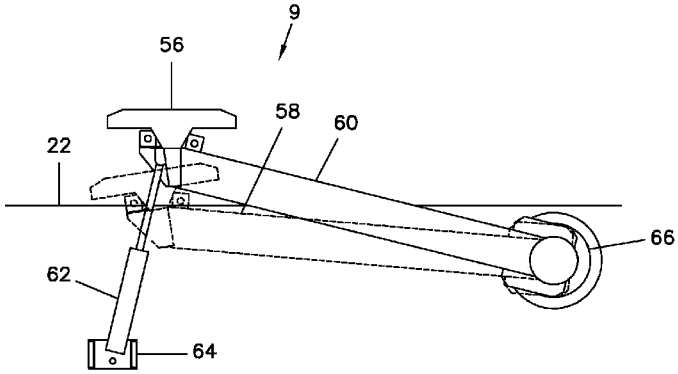
FIG. 10*a*, in a plan view, illustrates line fender of the berthing facility of FIG. 1.
Figure 10B:
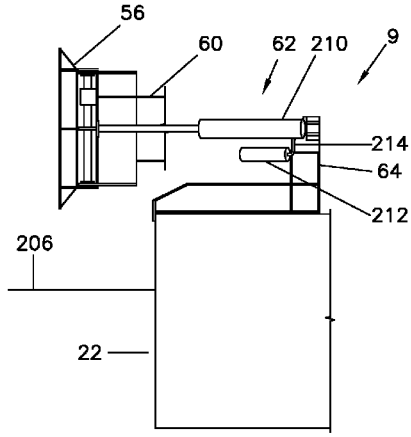
FIG. 10*b*, in a cross-sectional view, illustrates the line fender of FIG. 10*a*.

Each of the line fenders 9, tandem fenders 16 and wing walls 10 includes one or more hydraulic dampers 62 for absorbing vessel impacts. All of the hydraulic dampers 62 are configured and function in a similar manner. An exemplary hydraulic damper, as used in a line fender 9, is shown in FIG. 10*b*. The hydraulic damper 62 comprises: a ram 210 (comprising a ram cylinder and a ram piston); an accumulator 212; and a conduit 214 connecting the ram 210 and accumulator 212. The accumulator 212 contains a nitrogen charge and hydraulic oil in fluid communication with the hydraulic oil in the cylinder via the conduit 214. The nitrogen and hydraulic oil are kept isolated from each other by a floating cylinder (not shown) interposed between them. In line between the ram cylinder and the accumulator there is an flow-restricting orifice (not shown). The hydraulic damper 62 absorbs the energy of forces tending to compress the ram 210 (i.e. tending to push the ram piston into the ram cylinder), by heating the hydraulic fluid by forcing the fluid through the orifice, which heat then dissipates. Forcing hydraulic fluid into the accumulator 212 pushes the floating piston against the nitrogen charge, thus further compressing the nitrogen. The nitrogen charge thus both resists the compression of the ram 210 (though this effect is minimal) and, once the compressive forces on the ram 210 are reduced, forces the hydraulic fluid back into the ram 210 so as to cause the ram 210 to expand.

The hydraulic dampers 62 have several desirable characteristics for impact energy absorption. The stroke of the ram piston within the ram cylinder can be designed to control the reaction force for a desired force limit. Rebound force is provided by the nitrogen charge in the accumulator 212 and thus, the ram 210/accumulator 212 combination allows for accurate control of the rebound force after impact, such that the rebound force may relatively easily be made to be considerably less than for conventional rubber bumpers. The size of the container and the preset nitrogen charge pressure determine the rebound force. Reducing the rebound force is desirable as it reduces the tendency for the bow of a ferry to bounce off a wingwall when approaching the docking position, or for the side of a ferry to bounce off a line of fender when the ship is attempting to lay alongside the projecting finger.

As shown in FIG. 1, a plurality of line fenders 9 are mounted on the inside and outside edges of the offshore end module 20, the main pier module 22, and the first wingwall module 24. Referring to FIGS. 10*a* and 10*b*, there is illustrated, in a plan view and a cross-sectional view, respectively, a line fender 9. Each of the line fenders 9 is provided with a fender panel 56, a fender swing arm 60, a hydraulic damper 62, and a damper backing frame 64. The damper backing frame 64 is secured onto the pontoon 1 near an edge of pontoon. One end of the hydraulic damper 62 is secured to the damper backing frame 64. The swing arm 60 is rotatably attached to the pontoon 1 at the fender arm pivot 66. The fender arm pivot 66 is located near the same edge of the pontoon 1 as the damper backing frame 64, however, the fender arm pivot 66 is offset from the damper backing frame 64 such that the free end of the swing arm 60 lies roughly in front of, that is, to the water side of, the damper backing frame 64. The fender panel 56 is secured to the water side of the free end of the swing arm 60. The other end of the hydraulic damper 62 is secured to the pontoon side of the free end of the swing arm 60. As a ship impacts the fender panel 56, the swing arm 60 is forced to swing about the pivot 66 towards the pontoon, and towards the fender damper 62, whereby the fender damper 62 absorbs the energy of the ship impact. The position of the fender panel 56 and swing arm 60 in such a depressed position 58 is shown by dashed lines in FIG. 10*a*.

Referring to FIG. 1, each of the wingwalls 10 essentially comprises two coupled line fenders (except that there is only a single hydraulic damper 62) working in tandem. The wingwall fender panels of the wingwalls 10 are an elongated version of the fender panel 56 of one of the line fenders 9 such that a wingwall fender panel spans and is attached to the free ends of the swing arms of both of the coupled line fenders. A strut connected to links from each of the two swing arms, said strut located on the opposite side of the pivots from the wingwall fender panel, couple the swing arms such that the swing arms move the same degree of rotation irrespective of the locus of the vessel impact on the wingwall fender panel, thus providing parallel motion. A single hydraulic damper 62 connected between the pontoon 1 and the wingwall fender panel, absorbs impact forces and controls rebound of the wingwall fender panel.

Figure 5A:
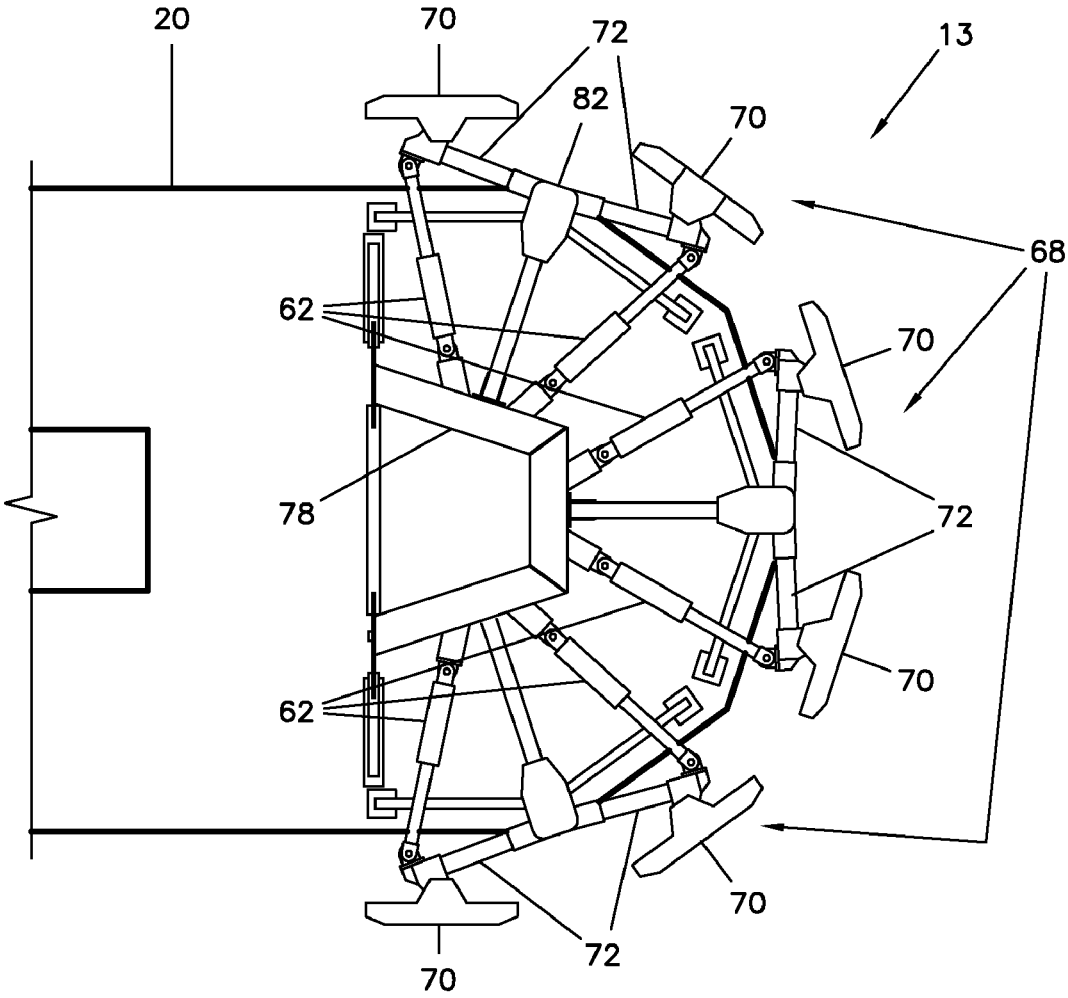
FIG. 5*a*, in a plan view, illustrates the turning dolphin of the berthing facility of FIG. 1.
Figure 5B:
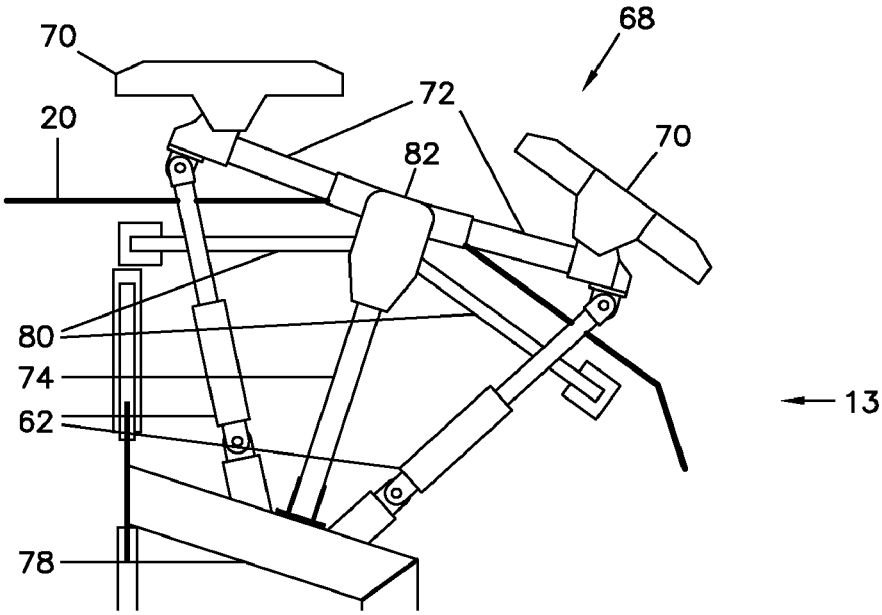
FIG. 5*b*, in a plan view, illustrates one of the tandem fenders of the turning dolphin of FIG. 5*a*.

As mentioned above, three tandem fenders 68 are located at the turning dolphin 13 and one tandem fender 68 is located at the distal end of the second wingwall module 28. In what follows, only the tandem fenders 68 located at the turning dolphin 13 are described, but the function and configuration of the tandem fender 68 located at the second wingwall module 28 is in all essential respects the same. The turning dolphin 13 has a curved periphery so that ships can come to rest against the turning dolphin 13 at an angle to the berth center line and pivot about the turning dolphin 13, for example so as to come into alignment with the berthing facility. Referring to FIGS. 5*a* and 5*b*, the turning dolphin 13 comprises a set of three tandem fenders 68 arrayed about the distal end of the offshore end module 20. Each of the tandem fenders 68 comprises two turning fender panels 70, two turning dolphin swing arms 72, a swing arm support post 74, and two hydraulic dampers 62. The first ends of the six hydraulic dampers 62 are mounted to a common turning damper backing frame 78, said turning damper backing frame 78 being secured to the distal end of the offshore end module 20. The proximal end of each swing arm support post 74 is also secured to the turning damper backing frame 78 such that the point of attachment of the first ends of the two hydraulic dampers and the swing arm support post 74 to the turning damper backing frame 78 forms the apex of a triangle with the swing arm support post 74 bisecting that triangle. The distal end 82 of the swing arm support post 74 is supported above the surface of the offshore end module 20 by a pair of braces 80. One end of each brace in the pair of braces 80 is secured to the distal end 82 of the swing arm support post 74 and the other end of each brace is secured to the offshore end module 20. The first ends of the two turning dolphin swing arms 72 are rotatably attached to the distal end 82 of the swing arm support post 74, such that the two turning dolphin swing arms 72 are opposed to each other. The distal end 82 of the swing arm support post 74 accordingly is the pivot point for each of the two turning dolphin swing arms 72. The two turning dolphin swing arms 72 may pivot independently of each other. The second end of each of the hydraulic dampers 62 is attached to the pontoon side of the second end of one of the swing arms 72. For each of the turning dolphin swing arms 72, one of the turning dolphin fender panels 70 is attached to the water side of the second end of each of the swing arms 72. As a ship impacts on one of the turning dolphin fender panels 70, the corresponding one of the turning dolphin swing arms 72 is forced towards the pontoon, and towards the corresponding one of the turning fender dampers 76, whereby the turning dolphin fender dampers 76 absorbs at least some of the force of the impact.

As shown in FIGS. 1, 2, 7*a*, 7*b* and 7*c*, the berthing facility 1 includes a truss ramp 6 that provides two-level two-lane loading with a long span, steel truss. To accommodate a tide range of roughly 12 feet, the truss ramp 6 of the embodiment described herein is roughly 160 feet long, which reduces slopes at extreme high tide and low tides to the extent that transition aprons are not required. Further, the long span design assists long, low trucks in clearing the angle break at the apron and shore abutment.

Figure 7A:
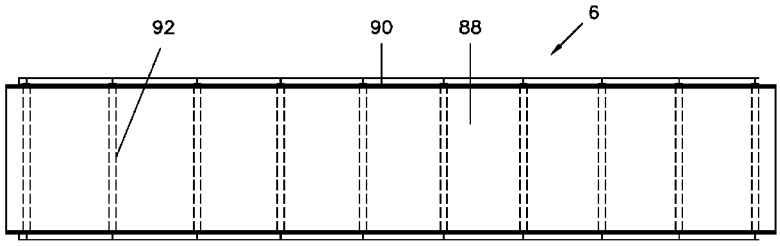
FIG. 7*a*, in a plan view, illustrates the long-span two-level truss ramp of the berthing facility of FIG. 1.
Figure 7B:
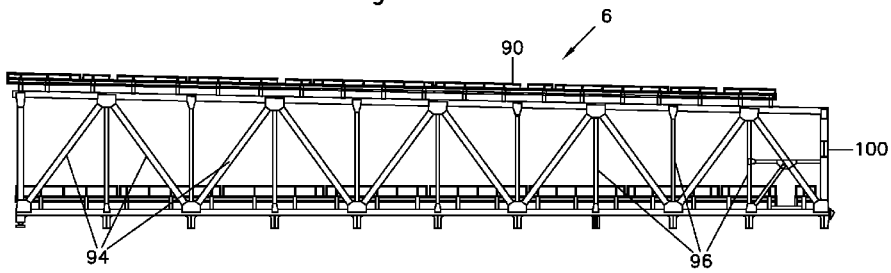
FIG. 7*b*, in a side elevational view, illustrates the ramp of FIG. 7*a*.
Figure 7C:
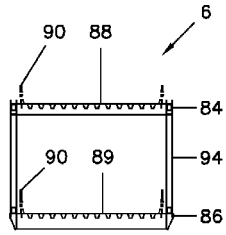
FIG. 7*c*, in an end elevational view, illustrates the ramp of FIG. 7*a*.

Referring to FIGS. 7*a*, 7*b*, and 7*c*, the generally rectangular truss ramp 6 comprises an upper level 84 and a lower level 86. The base of both the upper level 84 and lower level 86 of the truss ramp is a stiffened steel deck plate (the upper level deck plate 88, and the lower level deck plate 89) with non-skid surfaces over transverse floor beams 92. Both the upper level 84 and lower level 86 are provided with longitudinally running guardrails and curbs 90 on the outer edges of the upper level 84 and lower level 86. The configuration of the truss ramp 6 is unconventional in the sense that the upper level 84 and lower level 86 are in a fixed spaced-apart relationship, in that the upper level 84 and lower level 86 form a generally rectangular box shape supported by a framework of truss diagonals 94, truss verticals 96 and floor beams 92.

Figure 8A:
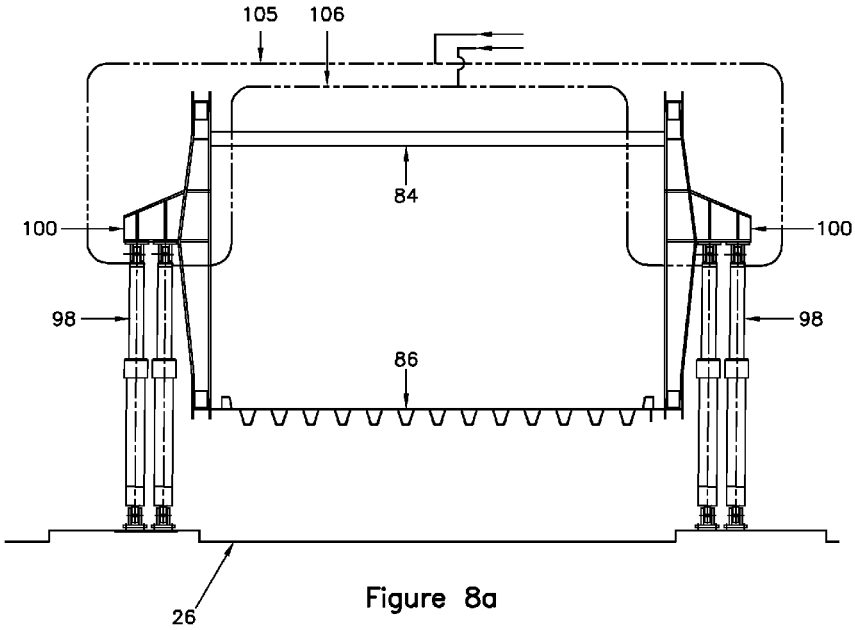
FIG. 8*a*, in a cross-sectional view, illustrates the ramp of FIG. 7*a* as supported by ramp lift hydraulic cylinders above the pontoon of the berthing facility of FIG. 1.
Figure 8B:
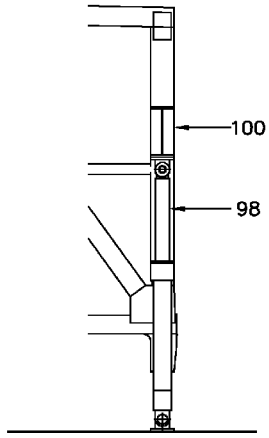
FIG. 8*b*, in a side elevational view, illustrates a ramp lift hydraulic cylinder of FIG. 8*a*.

Referring to FIGS. 8*a* and 8*b*, the distal end of the truss ramp 6 is supported on the ramp module 26 by two pairs of cross-connected ramp lift hydraulic cylinders 98. The lower end of the ramp lift hydraulic cylinders 98 are secured to the upper surface of the ramp module 6. The upper end of the ramp lift hydraulic cylinders 98 are secured to a pair of ramp lift brackets 100, said ramp lift brackets 100 being fixed to the outside framework of the distal end of the truss ramp 6 such that the ramp lift brackets 100 lie approximately half-way between the upper level 84 and the lower level 86 of the truss ramp 6. Preferably, two pairs of ramp lift hydraulic cylinders 98, with each pair independently pressurized, are used for redundancy; if one pair fails the other pair will support the ramp, thus reducing the risk that the ramp will drop while loaded.

To achieve ramp offshore end lift that behaves as if it is a single point of lift, the outer cylinder of the ramp lift hydraulic cylinders 98 on one side of the ramp 6 is piped in common through hydraulic lines 105 with the outer cylinder of the ramp lift hydraulic cylinders 98 on the other side of the ramp 6. Similarly, the inner cylinder of the ramp lift hydraulic cylinders 98 on one side of the ramp 6 is piped in common through hydraulic lines 104 with the inner cylinder of the ramp lift hydraulic cylinders 98 on the other side of the ramp 6. In the event that there is transverse rolling of the pontoon in response to waves or differential loading, hydraulic fluid is passively pumped from the cylinders on one side of the ramp 6 to the corresponding cylinders on the other side of the ramp 6, thereby maintaining a relatively stable vertical distance of the ramp 6 off the deck of the pontoon at the longitudinal centerline.

Figure 9:
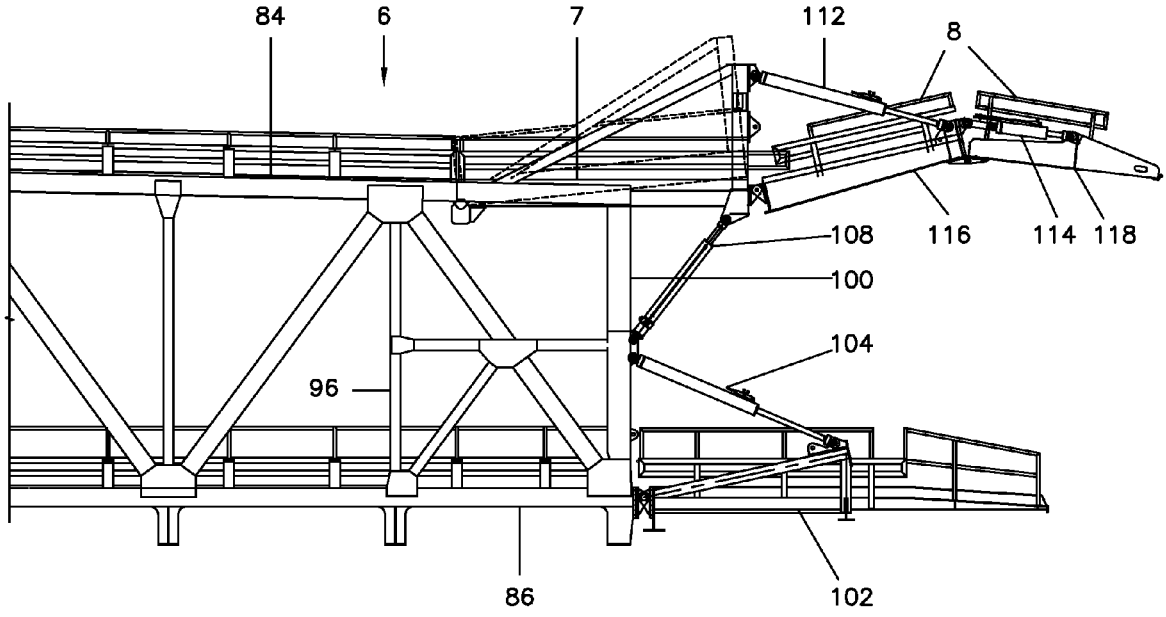
FIG. 9, in a side view, illustrates the three aprons of the ramp of the berthing facility of FIG. 1.

Referring to FIG. 9, for connection of a berthed ship to the ramp 6, an adjustable lower level apron 102 is pivotally attached to the distal end of the lower level 86 of the truss ramp 6 such that the lower level apron 102 may be pivoted about a horizontal transverse axis, to provide continuity between the deck plate 89 of the lower level 86 of the truss ramp 6 and the corresponding lower loading surface of the ferry. The angular orientation of the lower level apron 102 relative to the ramp 6, and thus the vertical proximity of the distal end of the lower level apron 102 to the lower loading surface of the ferry, can be adjusted with the use of a pair of lower level apron lift hydraulic cylinders 104, one end of one of said lower level apron lift cylinders 104 being attached to one of the pair of ramp lift brackets 100 and the other end of said lower level apron lift cylinders 104 being attached to approximately the midpoint of the lower level apron 102.

An adjustable upper level secondary apron 7 is pivotally connected by hinges to the distal end of the upper level 84 of the truss ramp 6 such that the upper level secondary apron 7 may be pivoted about a horizontal transverse axis, to provide driving surface continuity between the deck plate 88 of the upper level 84 of the truss ramp 6 and the corresponding upper loading surface of the ferry. The height of the upper level secondary apron 7 can be adjusted vertically with the use of a pair of upper level secondary apron lift hydraulic cylinders 108, one end of one of said upper level secondary apron lift cylinders 108 being attached to one of the pair of ramp lift brackets 100 and the other end of said upper level secondary apron lift cylinders 108 being attached to the distal end of the upper level secondary apron 7.

The first section 116 of a two-part, articulating upper primary apron 8 is pivotally connected by hinges to the distal end of the upper level secondary apron 7 such that the first section 116 of the upper primary apron 8 may be pivoted about a horizontal transverse axis. The second section 118 of the articulating upper primary apron 8 is pivotally connected by hinges to the distal end of the first section 116 of the upper primary apron such that the second section 118 may be pivoted about a horizontal transverse axis. The height of the articulating upper primary apron 8 can be adjusted vertically with the use of a pair of upper primary apron lift hydraulic cylinders 112. One end of each of the upper primary apron lift cylinders 112 is attached to the top of the distal end of the upper level secondary apron 7, while the other ends of the upper primary apron lift cylinders 112 are attached to the distal end of the first section 116 of the upper primary apron 8. Motion of the second section 118 of the upper primary apron 8 with respect to the first section of the upper primary apron 8 is controlled by a pair of primary apron hydraulic cylinders or struts 114 mounted between the first section 116 and the second section 118 of the upper primary apron 8.

Referring to FIG. 1, a low level abutment 120 (typically concrete on piles) on shore provides support for the proximal (shore end) of the truss ramp 6. The truss ramp 6 does not require support of the upper level at the shore end. Additional supports may be required to suit a particular site to accommodate vehicular access to the ramp upper level. The low level abutment 120 provides the connection to a steel portal frame (not shown) to support the shore-end of the truss ramp 6. The steel portal frame (not shown) is supported by stiffened steel plate infill (not shown).

Conveniently, a single operator can operate the ramp 6 and associated aprons. When a ferry is approaching the berthing facility 200, the operator of the truss ramp 6, knowing the height above the water of the deck of the lower access port of the ferry and the distance between the deck of the lower access port and the deck of the upper access port, will: use the ramp lift hydraulic cylinders 98 to set the distal end of the ramp at the desired height; use the lower level apron lift hydraulic cylinders 104 to position the lower level apron 102 so as to provide a safe clearance between it and the deck of the lower access port; use the upper level secondary apron lift hydraulic cylinders 108 to move the upper level secondary apron 7 so as to adjust for the distance between the deck of the lower access port and the deck of the upper access port; and use the upper primary apron lift hydraulic cylinders 112 and the primary apron hydraulic cylinders 114 to position the first section and second sections of the two-part, articulating upper primary apron 116, 118 so as to provide a safe clearance between the articulating upper primary apron 116, 118 and the deck of the upper access port. When the ferry is secured in the loading/unloading position, the operator; lowers the lower level apron 102 onto the deck of the lower access port; and lowers the articulating upper primary apron 116, 118 onto the deck of the upper access port, to permit vehicles to exit and enter the vehicle decks of the ferry.

The berthing facility 200, is provided with a service ramp having an access trestle 12 and a single lane service ramp span 11 attached thereto. The access trestle 12 is positioned next to the truss ramp 6. The service ramp span 11 is positioned to permit vehicular access to the decks of the pontoon modules. The access trestle 12 provides access from the shore for service vehicles to the service ramp span 11 and hence to the deck of the pontoon 1. The distal end of the service ramp span 11 is provided with a fixed, let down ramp (not shown) to allow the transition from the service ramp span 11 to the deck of the pontoon 1, allowing moderate slopes within the space available.

Other variations and modifications of the invention are possible. For example, depending on the seabed conditions, different types of anchoring arrangements may be required. Further, either fewer or more pontoon modules could be fabricated and later interconnected. A ramp having only a single level could be used for loading the ship and a means for adjusting the height of the ramp to allow loading of, say, the lower level of the ferry and then the upper level of the ferry in sequence could be provided. Further pontoon modules, a second ramp module and a third wingwall module, could be added to the shore end of the berth to form a mirror image of the existing ramp module and second wingwall module thus forming a double recess, one recess on each side of the longitudinal deck of the main pontoon modules, each recess dimensioned and configured to receive a ship or ferry and to accommodate the simultaneous berthing of two ships or ferries. In such a configuration, only the single service ramp would be required, however a second truss ramp would need to be positioned to facilitate loading of the second ship. All such modifications or variations and others that will occur to those skilled in the design of such systems are considered to be within the scope of the invention as defined by the claims appended hereto.

The invention claimed is:

1. A berthing facility for use in moving vehicles between a bow/stern-loading ferry floating in a body of water and a shore facility, the berthing facility comprising:

a) a floating pontoon having a bow/stern receiving section for receiving the bow or stern of a bow/stern-loading ferry, and a projecting finger against which may lie a side of a ferry having its bow or stern at the receiving section;

b) means for pivotally securing the bow/stern receiving section wherein the pontoon may pivot about a pivot axis in the vicinity of the bow/stern receiving section comprising:

i) a generally vertically oriented pylon, attached to the ground under the water and sized to project from the water surface; and ii) a pylon opening in the pontoon, having inner walls within which the pylon is disposed;

c) means for maintaining the projecting finger and thus the pontoon in a preferred pivotal orientation wherein the means resiliently resists lateral movement of the projecting finger from the preferred orientation;

d) a ramp having a shore end and a pontoon end, and having a vehicle pathway wherein vehicles may be driven on the vehicle pathway along the ramp;

e) means at a shore facility for pivotally supporting the ramp shore end; and f) means at the pontoon in the vicinity of the bow/stern receiving section for pivotally supporting the ramp pontoon end;

wherein, in use, force associated with a ferry impacting the projecting finger during a docking maneuver may be absorbed through lateral movement of the projecting finger; the ramp may pivot relative to the shore facility about a generally horizontal axis and relative to the pontoon about another generally horizontal axis so as to accommodate changes in water level relative to the shore facility, and the ramp may be used to convey vehicles between a shore facility and a bow/stern-loading ferry having its bow or stern at the receiving section.

2. The berthing facility of claim 1, wherein the projecting finger has a distal end, being the end of the projecting finger furthest from the bow/stern receiving section, and wherein the means for maintaining the projecting finger in the preferred pivotal orientation comprises:

a) a chain securing means mounted to the projecting finger proximate the distal end of the projecting finger;

b) two anchor means, a first anchor means disposed at the ground under the water off one side of the projecting finger and a second anchor means disposed at the ground under the water off the other side of the projecting finger;

c) a first chain having one end of its operative length connected to the first anchor means and having the other end secured in the chain securing means; and d) a second chain having one end of its operative length connected to the second anchor means and having the other end secured in the chain securing means.

3. The berthing facility of claim 2, wherein the chain securing means comprises a generally vertically disposed chain post having:

a) chain keepers at its upper end for engaging the links of the chains;

b) a hawse at its lower end through which the chains exit the chain securing means;

c) a chain post shaft between the top and bottom of the pontoon, within which the chain post is disposed; and d) a plurality of rubber bumpers, each attached to an inner wall of the shaft and to the chain post, so as to resiliently suspend the chain post within the shaft;

wherein the hawse is submerged to a sufficient depth to provide vertical clearance between the chains and a ferry using the berthing facility.

4. The berthing facility of claim 1, wherein, for accommodating ferries having two pairs of vehicle access ports, a lower pair of vehicle access ports and an upper pair of vehicle access ports, the ramp comprises two vehicle pathways, an upper vehicle pathway and a lower vehicle pathway, with the vehicle pathways in a fixed spaced-apart relationship.

5. The berthing facility of claim 4, further comprising:

a) a lower level apron pivotally attached to the ramp pontoon end in the vicinity of the lower vehicle pathway, wherein the pivotal orientation of the lower level apron relative to the ramp is controllable so as to provide vehicle path continuity between the lower vehicle pathway and a lower vehicle access port;

b) an upper level apron, having a proximal end and a distal end, and pivotally attached at its proximal end to the ramp pontoon end in the vicinity of the upper vehicle pathway, wherein the pivotal orientation of the upper level apron relative to the ramp is controllable; and c) an articulating apron pivotally connected to the distal end of the upper level apron, wherein the pivotal orientation of the articulating apron relative to the upper level apron is controllable;

wherein the pivotal orientation of the upper level apron and the articulating apron may be adjusted to accommodate ferries having different vertical distances between their upper and lower access ports so as to provide vehicle path continuity between the upper vehicle pathway and an upper vehicle access port.

6. The berthing facility of claim 5, wherein the articulating apron comprises two sub-aprons pivotally connected one to the other, wherein the pivotal orientation of one sub-apron relative to the other sub-apron is controllable.

7. The berthing facility of claim 1, further comprising means for adjusting the vertical disposition of the ramp pontoon end relative to the pontoon so that the ramp pontoon end may be raised or lowered to accommodate different ferries having vehicle access ports at different heights above the water surface.

8. The berthing facility of claim 7, wherein the means for adjusting the vertical disposition of the ramp pontoon end comprises two pairs of cross-connected ramp lift hydraulic cylinders having lower ends connected to the pontoon and upper ends connected to the ramp in the vicinity of the ramp pontoon end.

9. The berthing facility of claim 1, further comprising a plurality of fenders arrayed about the periphery of the pontoon for absorbing vessel impact forces, each fender comprising:

a) a swing arm, having one end pivotally attached to the pontoon;

b) a fender panel attached to an end of the swing arm opposite the end attached to the pontoon; and c) a hydraulic damper having one end attached to the pontoon and the other end attached to the swing arm, and comprising:

i) a ram having a piston and a cylinder;

ii) an accumulator, having a nitrogen charge chamber and a hydraulic oil chamber, and separating means, moveable responsive to pressure differentials, for separating the nitrogen charge and hydraulic oil;

iii) a conduit providing fluid communication between the interior of the cylinder and the hydraulic oil chamber; and iv) a restricting orifice in line between the cylinder and the hydraulic oil chamber for restricting flow of hydraulic oil as between them;

wherein, when a vessel impacts the fender panel with sufficient force, the ram is compressed forcing hydraulic fluid from the cylinder into the hydraulic oil chamber in the accumulator via the restricting orifice, thus compressing the nitrogen charge.

10. The berthing facility of claim 1, wherein the projecting finger has a distal end, being the end of the projecting finger furthest from the bow/stern receiving section and the distal end of the projecting finger is curved and has turning fenders arrayed about its curved periphery, wherein the distal end of the projecting finger is suitable for use as a turning dolphin.

11. The berthing facility of claim 10, wherein each of the turning fenders arrayed about the periphery of the distal end of the projecting finger comprises:

a) a swing arm, having one end pivotally attached to the pontoon;

b) a fender panel attached to an end of the swing arm opposite the end attached to the pontoon; and c) a hydraulic damper having one end attached to the pontoon and the other end attached to the swing arm, and comprising:

i) a ram having a piston and a cylinder;

ii) an accumulator, having a nitrogen charge chamber and a hydraulic oil chamber, and separating means, moveable responsive to pressure differentials, for separating the nitrogen charge and hydraulic oil;

iii) a conduit providing fluid communication between the interior of the cylinder and the hydraulic oil chamber; and iv) a restricting orifice in line between the cylinder and the hydraulic oil chamber for restricting flow of hydraulic oil as between them;

wherein, when a vessel impacts the fender panel with sufficient force, the ram is compressed forcing hydraulic fluid from the cylinder into the hydraulic oil chamber in the accumulator via the restricting orifice, thus compressing the nitrogen charge.

12. The berthing facility of claim 1, further comprising two wingwalls resiliently flexibly connected to the pontoon in the vicinity of the receiving section for guiding the end of a ferry into a desired position for loading and unloading, and for absorbing vessel impacts, wherein a hydraulic damper is connected between each wingwall and the pontoon, each hydraulic damper comprising:

a) a ram having a piston and a cylinder;

b) an accumulator, having a nitrogen charge chamber and a hydraulic oil chamber, and separating means, moveable responsive to pressure differentials, for separating the nitrogen charge and hydraulic oil;

c) a conduit providing fluid communication between the interior of the cylinder and the hydraulic oil chamber; and d) a restricting orifice in line between the cylinder and the hydraulic oil chamber for restricting flow of hydraulic oil as between them;

wherein, when a vessel impacts the wingwall with sufficient force, the ram is compressed forcing hydraulic fluid from the cylinder into the hydraulic oil chamber in the accumulator via the restricting orifice, thus compressing the nitrogen charge.

13. The berthing facility of claim 1, wherein the pontoon comprises a plurality of concrete modules joined one to another, wherein a) each of the modules has at least one join end comprising:

i) a circumferential flange having a planar face;

ii) a concavity surrounded by the flange;

iii) an internal work chamber; and iv) a plurality of bores running from the work chamber to the flange face; and b) the join between two modules comprises:

i) a plurality of nuts;

ii) a plurality of threadbars, each running from the work chamber of one module to the work chamber of the other module via a bore in the one module and an aligned bore in the other module, and each having a nut threaded on each end within a work chamber, the nuts tightened so as to tension the threadbars; and iii) a cast-in-place cement-grout key spanning the two concavities;

wherein the threadbar/nuts combinations resist tension across the join, and the cast-in-place key impedes relative shearing and rotational movement as between the modules.

14. The berthing facility of claim 13, wherein: each concavity has substantially rectangular inner walls; and the concavities are substantially aligned when the modules are aligned for joining one to the other, whereby the cast-in-place key is a substantially rectangular parallelepiped.

15. A berthing facility for use in moving vehicles between a shore facility and a bow/stern-loading ferry floating in a body of water and having two pairs of vehicle access ports, a pair of lower vehicle access ports and a pair of upper vehicle access ports, the berthing facility comprising:

a) a floating pontoon having a bow/stern receiving section for receiving the bow or stern of a bow/stern-loading ferry, and a projecting finger against which may lie a side of a ferry having its bow or stern at the receiving section;

b) means for pivotally securing the bow/stern receiving section wherein the pontoon may pivot about a pivot axis in the vicinity of the bow/stern receiving section;

c) means for maintaining the projecting finger and thus the pontoon in a preferred pivotal orientation wherein the means resiliently resists lateral movement of the projecting finger from the preferred orientation;

d) a ramp having a shore end and a pontoon end, and having two vehicle pathways, an upper vehicle pathway and a lower vehicle pathway, with the vehicle pathways in a fixed spaced-apart relationship, wherein vehicles may be driven on the vehicle pathways along the ramp;

e) means at the pontoon in the vicinity of the bow/stern receiving section for adjustably pivotally supporting the ramp pontoon end, wherein the ramp pontoon end may be raised or lowered relative to the pontoon to accommodate different ferries having their lower vehicle access ports at different heights above the water surface;

f) a lower level apron pivotally attached to the ramp pontoon end in the vicinity of the lower vehicle pathway, wherein the pivotal orientation of the lower level apron relative to the ramp is controllable so as to provide vehicle path continuity between the lower vehicle pathway and a lower vehicle access port;

g) an upper level apron assembly comprising:

i) an upper level apron, having a proximal end and a distal end, and pivotally attached at its proximal end to the ramp pontoon end in the vicinity of the upper vehicle pathway, wherein the pivotal orientation of the upper level apron relative to the ramp is controllable;

ii) an articulating apron pivotally connected to the distal end of the upper level apron, the articulating apron comprising two sub-aprons pivotally connected one to the other, wherein the pivotal orientation of one sub-apron relative to the other sub-apron is controllable, and wherein the pivotal orientation of the articulating apron relative to the upper level apron is controllable;

wherein the pivotal orientation of the upper level apron and the articulating apron may be adjusted to accommodate ferries having different vertical distances between their upper and lower access ports so as to provide vehicle path continuity between the upper vehicle pathway and an upper vehicle access port; and h) means at a shore facility for pivotally supporting the ramp shore end;

wherein, in use, force associated with a ferry impacting the projecting finger during a docking maneuver may be absorbed through lateral movement of the projecting finger; the ramp may pivot relative to the shore facility about a generally horizontal axis and relative to the pontoon about another generally horizontal axis so as to accommodate changes in water level relative to the shore facility, and the ramp may be used to convey vehicles between a shore facility and the upper and lower vehicle access ports of a bow/stern-loading ferry having its bow or stern at the receiving section.

16. A berthing facility for use in moving vehicles between a bow/stern-loading ferry floating in a body of water and a shore facility, the berthing facility comprising:

a) a floating pontoon having a bow/stern receiving section for receiving the bow or stern of a bow/stern-loading ferry, and a projecting finger against which may lie a side of a ferry having its bow or stern at the receiving section, wherein the pontoon comprises a plurality of concrete modules joined one to another, wherein i) each module has at least one join end comprising:

A) a circumferential flange having a planar face;

B) a concavity surrounded by the flange;

C) an internal work chamber; and

D) a plurality of bores running from the work chamber to the flange face; and ii) the join between two modules comprises:

A) a plurality of nuts;

B) a plurality of threadbars, each running from the work chamber of one module to the work chamber of the other module via a bore in the one module and an aligned bore in the other module, and each threadbar having a nut threaded on each end within a work chamber, the nuts tightened so as to tension the threadbars; and C) a cast-in-place cement-grout key spanning the two concavities;

wherein the threadbars and nuts resist tension across the join, and the cast-in-place key impedes relative shearing and rotational movement as between the modules;

b) means for pivotally securing the bow/stern receiving section wherein the pontoon may pivot about a pivot axis in the vicinity of the bow/stern receiving section;

c) means for maintaining the projecting finger and thus the pontoon in a preferred pivotal orientation wherein the means resiliently resists lateral movement of the projecting finger from the preferred orientation;

d) a ramp having a shore end and a pontoon end, and having a vehicle pathway wherein vehicles may be driven on the vehicle pathway along the ramp;

e) means at a shore facility for pivotally supporting the ramp shore end; and f) means at the pontoon in the vicinity of the bow/stern receiving section for pivotally supporting the ramp pontoon end;

wherein, in use, force associated with a ferry impacting the projecting finger during a docking maneuver may be absorbed through lateral movement of the projecting finger; the ramp may pivot relative to the shore facility about a generally horizontal axis and relative to the pontoon about another generally horizontal axis so as to accommodate changes in water level relative to the shore facility, and the ramp may be used to convey vehicles between a shore facility and a bow/stern-loading ferry having its bow or stern at the receiving section.

17. The berthing facility of claim 16, wherein each concavity has substantially rectangular inner walls and the concavities are substantially aligned when the modules are aligned for joining one to the other, whereby the cast-in-place key is a substantially rectangular parallelepiped.

18. A berthing facility for use in moving vehicles between a bow/stern-loading ferry floating in a body of water and a shore facility, the berthing facility comprising:

a) a floating pontoon having a bow/stern receiving section for receiving the bow or stern of a bow/stern-loading ferry, and a projecting finger against which may lie a side of a ferry having its bow or stern at the receiving section;

b) a plurality of fenders arrayed about the periphery of the pontoon for absorbing vessel impact forces, each fender comprising:

i) a swing arm, having one end pivotally attached to the pontoon;

ii) a fender panel attached to an end of the swing arm opposite the end attached to the pontoon; and iii) a hydraulic damper having one end attached to the pontoon and the other end attached to the swing arm, and comprising:

A) a ram having a piston and a cylinder;

B) an accumulator, having a nitrogen charge chamber and a hydraulic oil chamber, and separating means, moveable responsive to pressure differentials, for separating the nitrogen charge and hydraulic oil;

C) a conduit providing fluid communication between the interior of the cylinder and the hydraulic oil chamber; and D) a restricting orifice in line between the cylinder and the hydraulic oil chamber for restricting flow of hydraulic oil as between them;

wherein, when a vessel impacts the fender panel with sufficient force, the ram is compressed forcing hydraulic fluid from the cylinder into the hydraulic oil chamber in the accumulator via the restricting orifice, thus compressing the nitrogen charge;

c) means for pivotally securing the bow/stern receiving section wherein the pontoon may pivot about a pivot axis in the vicinity of the bow/stern receiving section;

d) means for maintaining the projecting finger and thus the pontoon in a preferred pivotal orientation wherein the means resiliently resists lateral movement of the projecting finger from the preferred orientation;

e) a ramp having a shore end and a pontoon end, and having a vehicle pathway wherein vehicles may be driven on the vehicle pathway along the ramp;

f) means at a shore facility for pivotally supporting the ramp shore end; and g) means at the pontoon in the vicinity of the bow/stern receiving section for pivotally supporting the ramp pontoon end;

wherein, in use, force associated with a ferry impacting the projecting finger during a docking maneuver may be absorbed through lateral movement of the projecting finger and by one or more fenders; the ramp may pivot relative to the shore facility about a generally horizontal axis and relative to the pontoon about another generally horizontal axis so as to accommodate changes in water level relative to the shore facility, and the ramp may be used to convey vehicles between a shore facility and a bow/stern-loading ferry having its bow or stern at the receiving section.

19. The berthing facility of claim 18, wherein the projecting finger has a distal end, being the end of the projecting finger furthest from the bow/stern receiving section and the distal end of the projecting finger is curved and has a plurality of the fenders arrayed about its curved periphery, whereby the distal end of the projecting finger is suitable for use as a turning dolphin.

20. The berthing facility of claim 18, further comprising two wingwalls resiliently flexibly connected to the pontoon in the vicinity of the receiving section for guiding the end of a ferry into the desired position for loading and unloading, and for absorbing vessel impacts, wherein a hydraulic damper is connected between each wingwall and the pontoon, each hydraulic damper comprising:

a) a ram having a piston and a cylinder;

b) an accumulator, having a nitrogen charge chamber and a hydraulic oil chamber, and separating means, moveable responsive to pressure differentials, for separating the nitrogen charge and hydraulic oil;

c) a conduit providing fluid communication between the interior of the cylinder and the hydraulic oil chamber; and d) a restricting orifice in line between the cylinder and the hydraulic oil chamber for restricting flow of hydraulic oil as between them;

wherein, when a vessel impacts the wingwall with sufficient force, the ram is compressed forcing hydraulic fluid from the cylinder into the hydraulic oil chamber in the accumulator via the restricting orifice, thus compressing the nitrogen charge.

* * * * *